US012209406B2

(12) United States Patent
Delcuve et al.

(10) Patent No.: US 12,209,406 B2
(45) Date of Patent: Jan. 28, 2025

(54) FACADE ELEMENT, BUILDING FACADE AND PROCESS FOR THE ASSEMBLING OF SUCH A BUILDING FACADE

(71) Applicant: ArcelorMittal, Luxembourg (LU)

(72) Inventors: Frédéric Delcuve, Embourg (BE); Peggy Schouller, Ars Laquenexy (FR)

(73) Assignee: ArcelorMittal, Luxembourg (LU)

( * ) Notice: Subject to any disclaimer, the term of this patent is extended or adjusted under 35 U.S.C. 154(b) by 292 days.

(21) Appl. No.: 17/778,970

(22) PCT Filed: Nov. 26, 2020

(86) PCT No.: PCT/IB2020/061167
§ 371 (c)(1),
(2) Date: May 23, 2022

(87) PCT Pub. No.: WO2021/105912
PCT Pub. Date: Jun. 3, 2021

(65) Prior Publication Data

US 2023/0010030 A1 Jan. 12, 2023

(30) Foreign Application Priority Data

Nov. 27, 2019 (WO) ..... PCT/IB2019/060236

(51) Int. Cl.
*E04B 1/66* (2006.01)
*E04B 2/92* (2006.01)
*E04C 2/292* (2006.01)

(52) U.S. Cl.
CPC ..... *E04B 1/665* (2013.01); *E04B 2/92* (2013.01); *E04C 2/292* (2013.01)

(58) Field of Classification Search
None
See application file for complete search history.

(56) References Cited

U.S. PATENT DOCUMENTS 4,869,037 A 9/1989 Murphy et al.
6,076,320 A * 6/2000 Butler ..... E02D 27/02 52/294

(Continued)

FOREIGN PATENT DOCUMENTS

ES 1187284 U 7/2017
GB 2481126 12/2011

(Continued)

OTHER PUBLICATIONS

ISR of PCT/IB2020/061167 dated Feb. 16, 2021.
Written opinion of ISA PCT/IB2020/061167.

*Primary Examiner* — Joshua K Ihezie
(74) *Attorney, Agent, or Firm* — Davidson Kappel LLC

(57) ABSTRACT

A facade element (1D), to be fastened to a building structure with other such facade elements (1A, 1B, 1C) to build one of the external walls of the building. The facade element includes an assembly of sandwich panels fastened to a metal framework, an upper waterproofing membrane that covers up an upper edge of the facade element, and a lower waterproofing membrane (5D) fixed to the inner face of the facade element. The lower waterproofing membrane extends beyond a lower edge of the facade element, up to an outer face of another facade element (1B) placed below. Both the upper and lower waterproofing membranes have overhanging parts (51D), extending beyond the left (35D) and right edges of the facade element. A building facade, and to a process for the assembling of a building facade is also provided.

14 Claims, 11 Drawing Sheets

(56) References Cited

U.S. PATENT DOCUMENTS

| | | | | |
|---|---|---|---|---|
| 2019/0093338 | A1 | 3/2019 | Kennedy et al. | |
| 2019/0292772 | A1* | 9/2019 | Kennedy | E04B 1/90 |
| 2022/0349175 | A1* | 11/2022 | Schoenhard | E04B 1/7604 |

FOREIGN PATENT DOCUMENTS

| | | | |
|---|---|---|---|
| JP | 2001193178 | A | 7/2001 |
| JP | 2013231344 | A | 11/2014 |
| WO | WO2018009129 | A1 | 1/2018 |

* cited by examiner

FACADE ELEMENT, BUILDING FACADE AND PROCESS FOR THE ASSEMBLING OF SUCH A BUILDING FACADE

The present invention relates to a facade element to be fastened to a building structure, with other such facade elements, to assemble one of the facades of the building. The invention relates more specifically to a facade element comprising an assembly of sandwich panels fastened to a metal framework.

The present invention also relates to a building facade comprising several such facade elements, and to a process for assembling such a building facade.

BACKGROUND

The use of prefabricated modules, such as concrete stairs, facade elements or partition wall elements, is becoming more and more frequent in the field of building construction. Fabricating such modules in advance, in dedicated factories, enables a better control of the manufacturing process than when such modules are produced in situ, on the building site. And it enables a faster construction of the building itself.

It is known for instance to build first a main building structure, that defines the various floors of the building, and then to mount facade elements between the different floors of this structure. These facade elements, that are some kinds of wall panel modules, constitute the lateral envelope of the building.

Document GB 2481126, for instance, describes such wall panel modules, to be fastened on a building structure, between two floors of the building. Each of these panel modules comprises several sandwiched panels arranged side by side and fastened to a metallic structure. In this document, two adjacent panel modules of a same facade are mounted side-by-side, in close contact with each other. The junction between these two panel modules is achieved by interlocking the two panels, along their respective lateral (vertical) edges, using complementary male/female locking means. The facade described in this document comprises lower panel modules (assembled side by side as explained above), and upper panel modules positioned above them. This facade comprises also an EPDM membrane (a membrane made of an Ethylene Propylene Diene Monomer rubber), extending on the lower edge of an upper panel module, and folded down on an outside face of an underneath lower panel module.

SUMMARY OF THE INVENTION

But this membrane does not provide sufficient waterproofing of the facade, and rain or runoffs water can still infiltrate the facade elements or oozes on the inner side of the facade.

Besides, this way to assemble laterally adjacent panel modules, tightly, so that they interlock with each other, is very restrictive from a mechanical point of view and requires a very precise positioning of the panel modules onto the building structure they equip.

It is an object of the present invention to provide a facade element comprising:

- a metal framework comprising at least two longitudinal metallic sections and two transverse metallic sections assembled all together so as to form a substantially rectangular framework,
- an assembly of sandwich panels comprising an insulation material sandwiched between an inner metallic sheet and an outer metallic sheet, each sandwich panel being fastened to the metal framework and interlocked with at least one adjacent sandwich panel along at least a part of one of its edges so that the assembly is delimited by an outer face, and inner face, a lower edge, an upper edge, a left edge and a right edge, the facade element further comprising:

- an upper waterproofing membrane covering the upper edge of the assembly of sandwich panels and extending on both at least an upper part of the outer face and at least an upper part of the inner face, the upper waterproofing membrane further comprising a left upper overhang extending beyond the left edge and a right upper overhang extending beyond the right edge,
- a lower waterproofing membrane extending along the lower edge of the assembly on the inner face and comprising:
  - a flap extending beyond the lower edge on a distance superior to the thickness of the lower edge,
  - a left lower overhang extending beyond the left edge,
  - a right lower overhang extending beyond the right edge.

The facade element according to the invention may also have the optional features listed below, considered individually or in combination:

- said at least two longitudinal metallic sections comprise an upper metallic section and a lower metallic section, at least a part of the upper waterproofing membrane being pressed against the inner face of the assembly by the upper metallic section, at least a part of the lower waterproofing membrane being pressed against the inner face of the assembly by the lower metallic section;
- the facade element comprises a compressible, watertight strip extending along at least a part of the lower edge of the assembly of sandwich panels, in contact with said lower edge;
- the facade element comprises a side waterproofing membrane attached on the inner face of the assembly of sandwich panels, wherein:
  - the side waterproofing membrane is attached along at least a part of the left edge of the assembly of sandwich panels and extends beyond said left edge, on a left side of the assembly of sandwich panels, or wherein
  - the side waterproofing membrane is attached along at least a part of the right edge of the assembly of sandwich panels and extends beyond said right edge, on a right side of the assembly of sandwich panels;
- the facade element comprises a longitudinal, rain protective profiled lid which extends longitudinally along at least a part of the lower edge of the assembly of sandwich panels, which is fastened to the outer face of the assembly of sandwich panels and which extends outwardly and downwardly, beyond the lower edge of said assembly.

A second subject of the invention consists of a building facade, comprising at least four facade elements such as the one described above, namely a first, a second, a third and a fourth facade element fastened to a building structure,

- the right edge of the first facade element facing the left edge of the second facade element, the right upper overhang of the first facade element and the left upper overhang of the second facade element overlapping at least partially each other while maintaining a gap between the first and second facade elements, the lower edge of the third facade element facing the upper edge of the first facade element, the flap of the third facade element extending from the inner face of the third facade element to the outer face of the first facade element, the right edge of the third facade element facing the left edge of the fourth facade element, the right lower overhang of the third facade element and the left lower overhang of the fourth facade element overlapping at least partially each other while maintaining a gap between the third and fourth facade elements, the lower edge of the fourth facade element facing the upper edge of the second facade element, the flap of the fourth facade element extending from the inner face of the fourth facade element to the outer face of the second facade element, the gap between the first and second facade elements being closed with a first side waterproofing membrane attached on the inner faces of both the first and second facade elements, the gap between the third and fourth facade elements being closed with a second side waterproofing membrane attached on the inner faces of both the third and fourth facade elements.

The building facade according to the invention may also have the optional features listed below, considered individually or in combination:

the facade is such that:

the left lower overhang of the fourth facade element covers up at least partially the right lower overhang of the third facade element, the right lower overhang of the third facade element covers up at least partially the right upper overhang of the first facade element, and the right upper overhang of the first facade element covers up at least partially the left upper overhang of the second facade element, or such that the right lower overhang of the third facade element covers up at least partially the left lower overhang of the fourth facade element, the left lower overhang of the fourth facade element covers up at least partially the left upper overhang of the second facade element and the left upper overhang of the second facade element covers up at least partially the right upper overhang of the first facade element;

the facade is such that:

the left lower overhang of the fourth facade element covers up at least partially the right lower overhang of the third facade element, the right lower overhang of the third facade element covers up at least partially the left upper overhang of the second facade element, and the left upper overhang of the second facade element covers up at least partially the right upper overhang of the first facade element, or such that the right lower overhang of the third facade element covers up at least partially the left lower overhang of the fourth facade element, the left lower overhang of the fourth facade element covers up at least partially right upper overhang of the first facade element, and the right upper overhang of the first facade element covers up at least partially the left upper overhang of the second facade element;

the gap between the first and second facade elements has a width of 4 centimeters at least and is filed with an insulating material;

the gap between the third and fourth facade elements has a width of 4 centimeters at least and is filed with an insulating material;

a vertical gap is maintained between the first and third facade elements, and between the second and fourth facade elements, the facade further comprising:

one or more fire deflectors fastened to a lower part of the inner face of the third facade element, each fire deflectors extending transversally across said vertical gap, up to the outside of the assembly of sandwich panels of the third facade element, to isolate the third facade element from the first facade element, and one or more fire deflectors fastened to a lower part of the inner face of the fourth facade element, each of these fire deflectors extending transversally across said vertical gap, up to the outside of the assembly of sandwich panels of the fourth facade element, to isolate the fourth facade element from the second facade element.

A third subject of the invention consists of a process for the assembling of a building facade, the facade comprising a first, a second, a third and a fourth facade element such as the one described above, the process comprising:

positioning and fastening the first facade element and the second facade element on a building structure, so that:

the left edge of the second facade element and the right edge of the first facade element are parallel to each other, facing each other, and so that the right upper overhang of the first facade element and the left upper overhang of the second facade element overlap at least partially each other while maintaining a gap between the first and second facade elements, closing the gap between the first and second facade elements with a first side waterproofing membrane attached on the inner faces of both the first and second facade elements, positioning and fastening the third facade element and the fourth facade element on the building structure, so that:

the lower edge of the third facade element and the upper edge of the first facade element are parallel to each other, facing each other, the flap of the third facade element extends from the inner face of the third facade element to the outer face of the first facade element, the lower edge of the fourth facade element and the upper edge of the second facade element are parallel to each other, facing each other, the flap of the fourth facade element extends from the inner face of the fourth facade element to the outer face of the second facade element, the left edge of the fourth facade element and the right edge of the third facade element are parallel to each other, facing each other, and so that the right lower overhang of the third facade element and the left lower overhang of the fourth facade element overlap at least partially each other while maintaining a gap between the third and fourth facade elements.

The invention concerns, more specifically, a process for the assembling of a building facade, comprising the following steps:

(i) providing at least a first, a second, a third and a fourth facade element as described above, (ii) positioning and fastening the first facade element on a building structure, (iii) positioning the left edge, or the right edge, of the second facade element along the right edge, or the left edge, of the first facade element so that the right upper overhang, or respectively the left upper overhang, of the first facade element and the left upper overhang, respectively the right upper overhang, of the second facade element overlap at least partially each other while maintaining a gap between the first and second facade elements, (iv) closing the gap between the first and second facade elements with a first side waterproofing membrane attached on the inner faces of both the first and second facade elements, (v) positioning the lower edge of the third facade element along the upper edge of the first, respectively second, facade element so that the flap of the third facade element extends on the outer face of the first, respectively second, facade element, (vi) positioning simultaneously or in any order:

the lower edge of the fourth facade element along the upper edge of the second, respectively first, facade element so that the flap of the fourth facade element extends on the outer face of the second, respectively first, facade element, the left edge, respectively the right edge, of the fourth facade element along the right edge, respectively the left edge, of the third facade element so that the right lower overhang, respectively the left lower overhang, of the third facade element and the left lower overhang, respectively the right lower overhang, of the fourth facade element overlap at least partially each other while maintaining a gap between the third and fourth facade elements, (vii) closing the gap between the third and fourth facade elements with a second side waterproofing membrane attached on the inner faces of both the third and fourth facade elements.

The process according to the invention may also have the optional features listed below, considered individually or in combination:

the process comprises:

gluing the right upper overhang of the first facade element over the left upper overhang of the second facade element, in step (iii); then gluing the right lower overhang of the third facade element over the right upper overhang of the first facade element, in step (v); and then gluing the left lower overhang of the fourth facade element over the right lower overhang of the third facade element, in step (vi);

the process comprises:

gluing the left upper overhang of the second facade element over the right upper overhang of the first facade element, in step (iii); then gluing the right lower overhang of the third facade element over the left upper overhang of the second facade element, in step (v); and then gluing the left lower overhang of the fourth facade element over the right lower overhang of the third facade element, in step (vi);

the process comprises:

gluing the flap of the lower waterproofing membrane of the third facade element along the upper waterproofing membrane of the first facade element, in step (v); and gluing the flap of the lower waterproofing membrane of the fourth facade element along the upper waterproofing membrane of the second facade element, in step (vi);

the process comprises:

(iv') filling the gap between the first and second facade elements with an insulating material; and (vii') filling the gap between the third and fourth facade elements with an insulating material.

BRIEF DESCRIPTION OF THE DRAWINGS

Other characteristics and advantages of the invention will be described in greater detail in the following description.

The invention will be better understood by reading the following description, which is provided purely for purposes of explanation and is in no way intended to be restrictive, with reference to.

DETAILED DESCRIPTION

Figure 1:
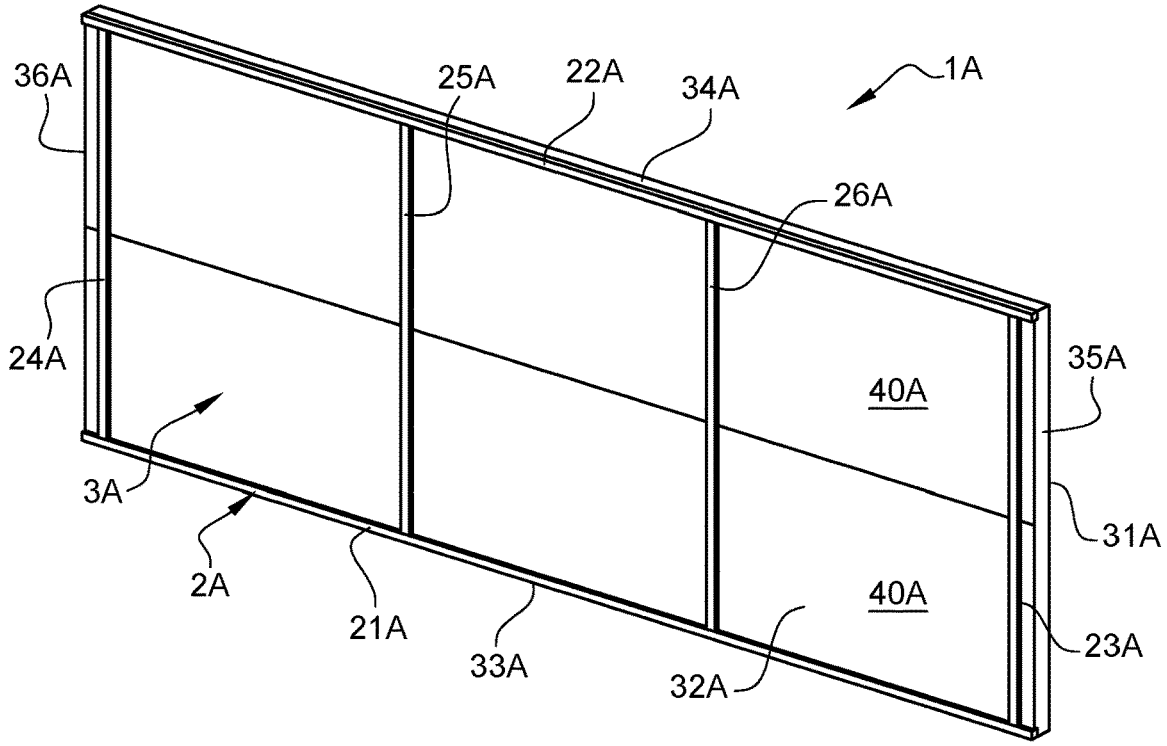
FIG. 1, which represents schematically a facade element according to the invention.

FIG. 1 represents a facade element 1A, according to the invention, to be fastened to a main structure of a building.

Figure 19:
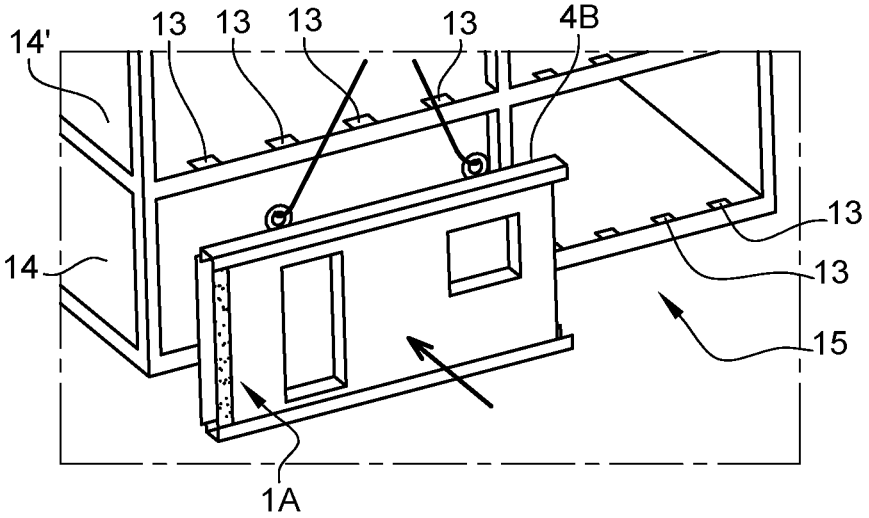
FIGS. 19 to 31 represent different steps of the assembling of a building facade according to the invention.
Figure 20:
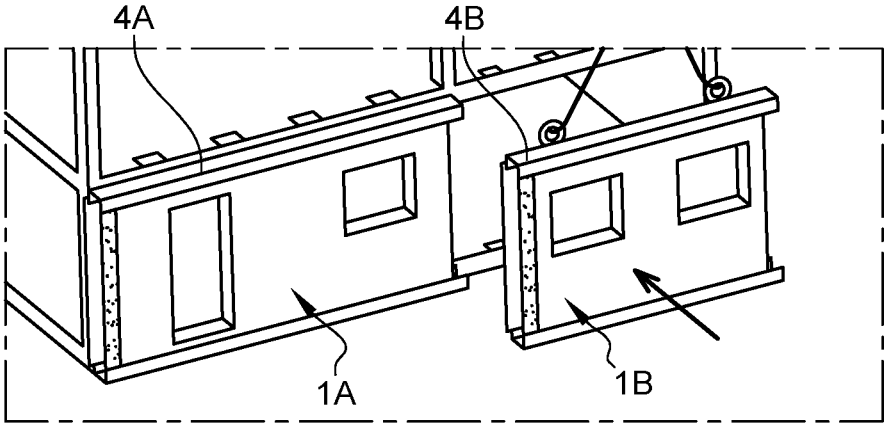

The main structure of the building comprises its inner, loadbearing structure, and the floors of the building. As represented in FIG. 19, the main structure 15 of the building may comprise, for instance, inner loadbearing walls and/or pillars, and reinforced concrete slabs 14, 14' defining the different floors of the building, these slabs being supported by the inner walls/pillars mentioned above.

The facade element 1A is configured to be fastened to one or more floors of the building. In the embodiments described below, it is configured more precisely to be placed between two successive floors 14, 14' of the building, in order to close the building laterally.

Different facade elements of this kind can be fastened to the main structure 15 of the building, side by side, to form one of the external walls of the building (that is to say to form one of the facade of the building), or at least to form a part of one of these external walls. The facade element according to the invention, for instance the one of FIG. 1, can be used to build facades of detached or adjoining house, as well as office buildings or residential blocks of flats.

As will be explained below, the facade element is provided with specific waterproofing elements that enable to join different facade elements of a same facade together in a watertight and convenient manner, even if substantial vertical and lateral gaps are maintained between these facade elements.

Such gaps make the assembling of the facade easier than the assembling of a gap-less structure (as it provides a greater freedom regarding the positioning of the facade elements on the building) and enable to accommodate slight deformations of the main structure of the building. And maintaining substantial gaps between adjacent facade elements, rather than minimal ones, makes the filing of such gaps with isolating material easier.

The facade element 1A of FIG. 1, and different alternatives to this element will be presented first, with reference to FIGS. 1 to 7.

A building facade 10 comprising several such facade elements, and a process for assembling such a building facade will be described then, with reference to FIGS. 8 to 17.

Facade Element

The facade element 1A comprises a metal framework 2A, and an assembly 3A of sandwich panels 40A fastened to the metal framework 2A. The metal framework 2A provides a structure to hold the sandwich panels 40A, and to fasten the facade element 1A to the main structure of the building.

The metal framework 2A comprises at least two longitudinal metallic sections, namely an upper metallic section 22A and a lower metallic section 21A, and two transverse metallic sections, namely a left metallic section 23A and a right metallic section 24A. These different sections 21A, 22A, 23A, 24A are assembled all together, for instance welded together, so as to form a substantially rectangular framework.

This substantially rectangular framework may be reinforced by additional metallic sections, either parallel to the transverse sections or to the longitudinal sections mentioned above. These additional metallic sections are fixed, for instance welded, to the main, peripheral sections 21A, 22A, 23A, 24A of the metal framework 2A. In the case of FIG. 1, for instance, the metal framework 2A comprises two additional transverse metallic sections 25A, 26A, each of them being substantially parallel to the left and right metallic sections 23A, 24A and being fixed to the upper and to the lower metallic sections 21A, 22A of the metal framework 2A.

As represented in the figures, the metallic sections of the framework are tubular profiles with a substantially rectangular or square cross section. But other kinds of metallic sections could also be used, to build the metal framework of the facade element. For instance, this metal framework could be built from metallic sections with a cross section in the shape of an "I" or in the shape of an "H" (like "IPE" beams—that is "European standard universal I beams with parallel flanges" for example).

Figure 2:
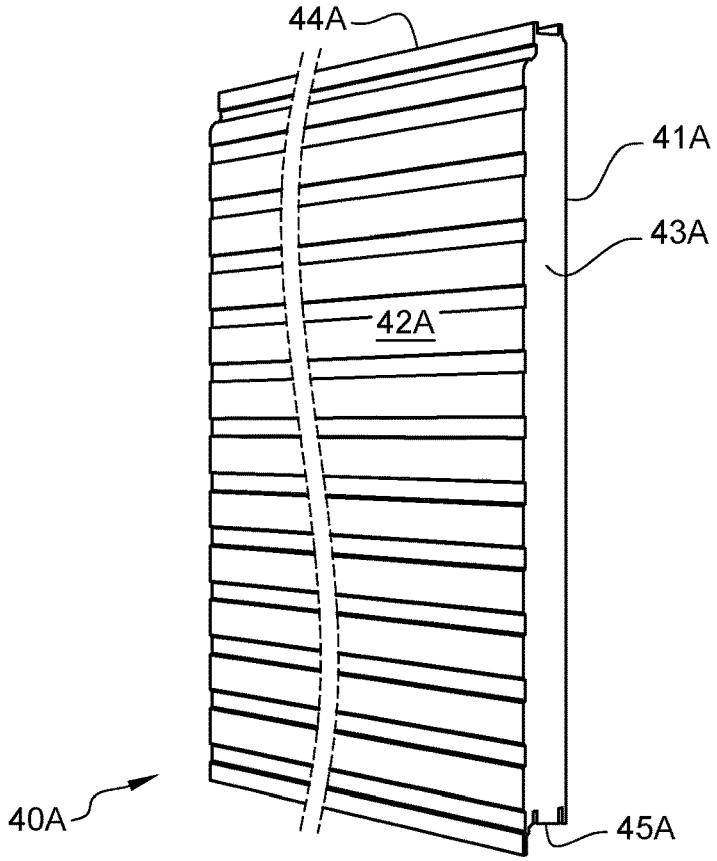
FIG. 2, which represents schematically a sandwich panel of the facade element of FIG. 1.

FIG. 2 shows one of the sandwich panels 40A of the facade element 1A, in perspective. This panel, as each sandwich panel 40A of the facade element 1A, comprises an insulation material 43A sandwiched between an inner metallic sheet 41A and an outer metallic sheet 42A.

It should be noted that "inner" and "outer" as used in this application refer to the position of the facade element 1A on the building. So, the outer metallic sheet 42A is facing the outside of the building and the inner metallic sheet 41A is facing the inside of the building, when the facade element 1 is in position on the building.

The insulation material 43A can be any material providing some insulation to the panel 40A. It can be, by way of non-restricting examples, polyurethane foam, polyisocyanurate foam, phenolic foam, mineral wool. According to a variant of the invention, the insulation material is a composite comprising a lower layer of mineral wool and an upper layer of foamed material.

The inner and outer metallic sheets 41A and 42A can be made of steel, aluminum, copper or zinc. They are preferably made of previously galvanized and/or pre-coated steel to protect them against corrosion. Their thickness is low compared to their other dimensions. Generally speaking, for each of these sheets, the sheet thickness is 400 to 4000 times lower than its width.

The inner and outer metallic sheets 41A and 42A of the sandwich panel 40A will preferably have been previously formed with the aid of any known forming method, including, by way of non-restricting examples, bending, forming, stamping and molding.

The forming mentioned above could lead among other things to the formation of ribs, stiffeners or grooves on the surface of one or both of these metallic sheets. Throughout the text, a rib is understood to mean a projection formed on the surface of the sheet. The rib may have a trapezoidal shape or a rectangular, corrugated, sinusoidal or even omega shape, for example. It includes a top central part and two lateral wings. A stiffener is a rib of limited height, generally 10 to 30 times lower than a rib. Throughout the text, a groove is understood to mean a recess formed on the surface of the panel. The groove can have shapes similar to the ones offered for ribs. Ribs, stiffeners or grooves are generally placed in parallel to longitudinal edges of the sheet notably to render the sheet more rigid.

In the example of FIG. 2, the inner and outer metallic sheets 41A and 42A have a substantially flat surface, with stiffeners. In this example, the depth of these ribs is smaller than one tenth of the thickness of the panel. But metallic sheets with deeper ribs or structures could also be used, to build the sandwich panels of the facade element.

The outer metallic sheet 41A is joined to the inner metallic sheet 42A by a first longitudinal edge 44A, and, on an opposite side of the first longitudinal edge 44A, by a second longitudinal edge 45A. Each of these longitudinal edges extends longitudinally, along the panel 40A.

The sandwich panels 40A of the facade element 1A are assembled side-by-side, parallel to each other, onto the metal framework 2A. Each of these sandwich panels 40A interlocks with at least one adjacent sandwich panel 40A, along at least a part of one of its longitudinal edges 44A, 45A. More precisely, for each couple of adjacent sandwich panels 40A, the first longitudinal edge 44A of one of these two panels interlocks with the second longitudinal edge 45A of the other of these two adjacent panels. They interlock with each other in a watertight/airtight manner.

In the example of FIG. 1, the different sandwich panels 40A of the facade element 1A are identical, or at least substantially identical (except possibly regarding their length). So, each of these sandwich panels 40A is configured so that it can interlock with an adjacent, identical sandwich panel, either along its first longitudinal edge 44A, or along its second longitudinal edge 45A. Here, each of these sandwich panels 40A comprises, on one of its longitudinal edges 44A, 45A, a male interlocking part, and on its other longitudinal edge 45A, 44A, a female interlocking part such that the male and female interlocking parts interlock into one another when two panels are assembled.

As represented in FIG. 2, the first longitudinal edge 44A, and the second longitudinal edge 45A of each sandwich panel 40A have complementary, or at least substantially complementary shapes (see FIG. 2), so that the panel can interlock, on either of its sides, with another identical panel. As represented in FIG. 2, the first longitudinal edge 44A of the panel may be in the shape of a double male rail with two narrow longitudinal tenons, while the second longitudinal edge 45A is in the shape of a double female rail, with two mortises in which the two longitudinal ribs of the first longitudinal edge 44A of another panel can be inserted. As one will appreciate, the first and second longitudinal edge may have (complementary) shapes different than in the case of FIG. 2.

Figure 3:
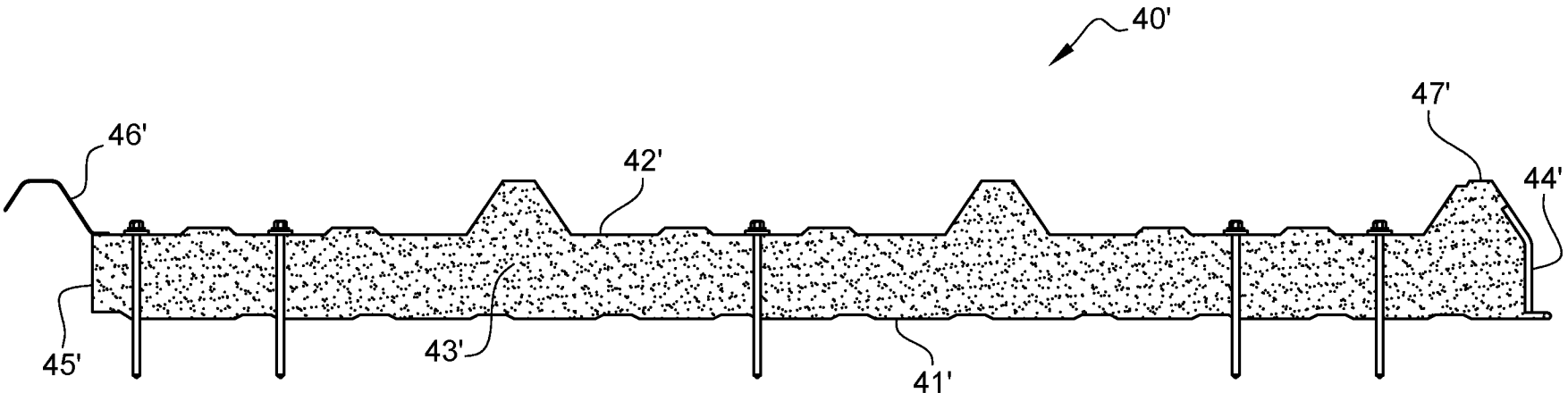
FIG. 3, which represents schematically another, alternative sandwich panel that could be used to build of the facade element according to the invention.

Alternatively, like in FIG. 3, the longitudinal edges 44', 45' of the sandwich panels 40' of the facade element could be substantially flat. In this case, the outer metallic sheet 42' (or the inner metallic sheet) of each panel 40' may extend beyond one of the longitudinal edges of the panel to form a longitudinal lid 46' (in other words a kind of flap) configured to interlock with a complementary longitudinal rib 47' protruding on the outer face of another, adjacent panel. In this case, the longitudinal rib is parallel to one of the longitudinal edges of the adjacent panel, and is located close to this edge. In this case, each panel 40' comprises: on one side, the longitudinal lid 46' mentioned above, and, on the opposite side, the complementary longitudinal rib 47'. The longitudinal rib 47' may be trapezoidal, the longitudinal lid 46' having then a trapezoidal cross section (see FIG. 3). When two such panels 40' are interlocked with each other, the first longitudinal edge 44' of one of these two panels come into contact with the second longitudinal edge 45' of the other of these two panels (these two substantially flat edges being somehow pressed against each other to make the interlock watertight and airtight).

Each sandwich panel 40A of the facade element 1A is fastened to the metal framework 2A, for instance by screws (e.g.: self-drilling screws) passing through the panel 40A to engage with the metallic framework 2A.

The assembly of sandwich panels 40A of the facade element 1A is delimited by an outer face 31A, an inner face 32A, a lower edge 33A, an upper edge 34A, a left edge 35A and a right edge 36A (see FIG. 1). The outer face 31A of the assembly is formed by all the outer metallic sheets 42A of the sandwich panels 40A of the assembly. The inner face 32A is formed by all the inner metallic sheets 43A of these sandwich panels 40A.

The metal framework 2A is located on the inner side of the assembly of sandwich panels 40A, opposite to its outer face 31A.

It should be noted that the terms "lower", "upper", "above", "below", "lowest", "highest", "top", "bottom", "left", "right" . . . as used in this application refer to the positions and orientations of the different parts of the facade element when the latter is positioned vertically on a building structure, and fastened on this building structure (in its final position). More particularly, the terms "left" and "right" refer to the positions and orientations of the different parts of the facade element when the facade element, fastened on this building structure, is seen from the outside of the building.

Besides, in this application, the outer face 31A, inner face 32A, lower edge 33A, upper edge 34A, left edge 35A and right edge 36A of the assembly of sandwich panels 40A are also referred to, indifferently, as the outer face 31A, inner face 32A, lower edge 33A, etc. . . . of the corresponding facade element.

Here, the edges 33A, 34A, 35A, 36A of the facade element 1A are substantially plane. They are more particularly deprived of fastening means like the rail or lid mentioned above. Such plane edges may be obtained by cutting up longitudinally the sandwich panels located most on the periphery of the facade element 1A.

Figure 4:
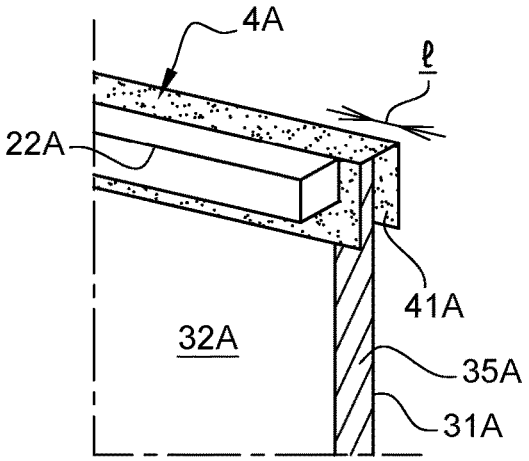
FIGS. 4 to 7, which represent in more detail, respectively, an upper and left part of the facade element of FIG. 1, a lower and left part, an upper and right part and a lower and right part of the facade element of FIG. 1.
Figure 6:
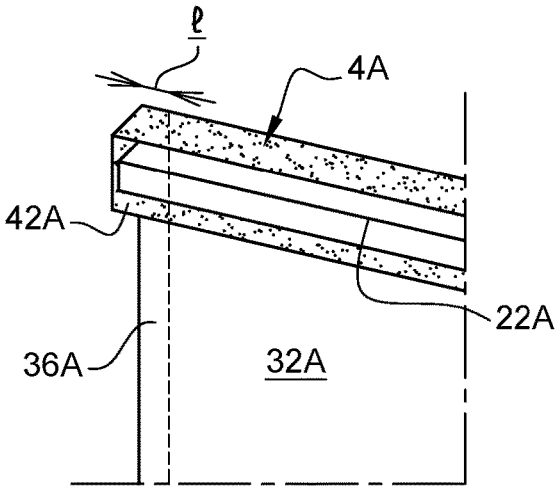

Remarkably, the facade element 1A further comprises an upper waterproofing membrane 4A that covers up the upper edge 34A of the assembly of sandwich panels 40A (see FIGS. 4 and 6). The upper waterproofing membrane 4A may, like here, cover the whole length of the upper edge 34A. This membrane is folded on each side of the upper edge 34A, and thus covers also an upper part of the outer face 31A of the assembly of sandwich panels, and an upper part of its inner face 32A. The upper waterproofing membrane 4A thus extends from the outer face 31A of the assembly 3A of sandwich panels, to the inner face 32A of this assembly.

As can be seen in FIGS. 4 and 6, the upper waterproofing membrane 4A comprises a left upper overhang 41A extending beyond the left edge 35A of the assembly of sandwich panels 40A, and a right upper overhang 42A extending beyond the right edge 36A of the assembly.

The upper waterproofing membrane 4A, that covers up the upper edge 34A of the assembly of sandwich panels from side to side, prevents efficiently water from seeping into the insulation material 43A of the sandwich panels 40A.

Besides, as it will explained below (when describing a facade 10 obtained by assembling different facade elements of this kind), thanks to the membrane overhangs 41A, 42A mentioned above, two adjacent facade elements can be joined together in a watertight manner, while maintaining a lateral (horizontal) gap between them, which makes the assembling of the facade easier than for a gap-less structure (as it provides a greater freedom regarding the positioning of the facade elements on the building).

Here, the upper waterproofing membrane 4A, is made in one piece. It is flexible and waterproof. It may be made of a waterproof elastomeric material, such as Ethylene Propylene Diene Monomer rubber (usually referred to as "EPDM"). The upper waterproofing membrane 4A may have a thickness comprised between 0.3 and 2 millimeters.

The left upper overhang 41A may extend, beyond the left edge 35A of the assembly of sandwich panels 40A, over a length comprised between 1 and 7 centimeters, for instance greater than 3 centimeters. The right upper overhang 42A may extend also, beyond the right edge 36 of the assembly of sandwich panels 40, over a length comprised between 1 and 7 centimeters, for instance greater than 3 centimeters. Here, the left and right upper overhangs 41A, 42A have the same length l.

To fix the upper waterproofing membrane 4A on the assembly of sandwich panels 40A, a part of the upper waterproofing membrane 4A may be pressed against the inner face 32A of the assembly by the upper metallic section 22A of the metal framework 2A. In other words, the upper waterproofing membrane 4A may be sandwiched between the upper metallic section 22A and the inner face 32A of the assembly of sandwiched panels 40A, all along the upper metallic section 22A. Fixing the membrane on the assembly of sandwiched panels in this way is fast, convenient, and cost-effective.

The upper waterproofing membrane 4A is further fixed on the assembly of sandwich panels 40A by gluing: the upper waterproofing membrane 4A is glued both on the upper part of the outer face 31A, and on the upper part of the inner face 32A of the facade element 1A.

Figure 5:
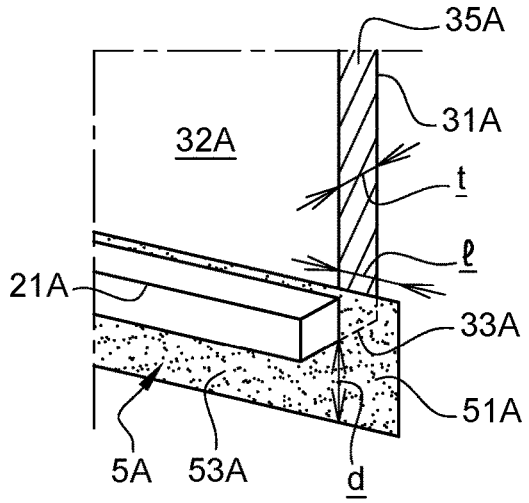
Figure 7:
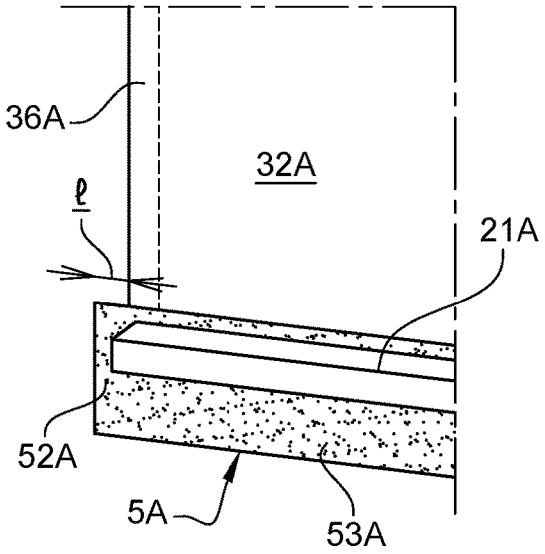
Figure 8:
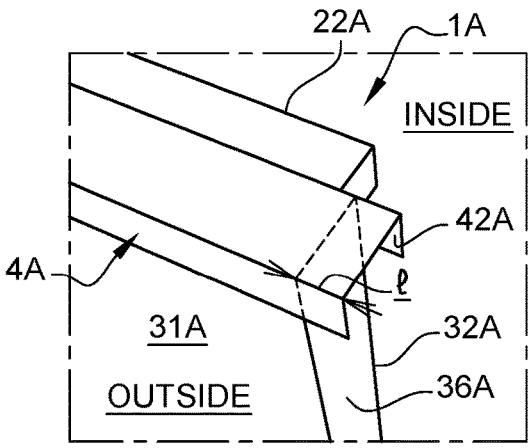
FIGS. 8 to 15, which represent different steps of a process for assembling a building facade that comprises several facade elements such as the one of FIG. 1.

The facade element 1A comprises also a lower waterproofing membrane 5A, that extends along the lower edge 33A of the assembly of sandwich panels 40A, on the inner face 32A of this assembly. As can be seen in FIGS. 5 and 7, the lower waterproofing membrane 5A comprises:

- a left lower overhang 51A extending beyond the left edge 35A of the assembly,
- a right lower overhang 52A extending beyond the right edge 36A of the assembly, and
- a flap 53A extending beyond the lower edge 33A of the assembly.

Here, the lower waterproofing membrane 5A is made in one piece. In other words, here, the flap 53A and the left and right lower overhangs 51A and 52A designate different parts (extending beyond different edges of the assembly) of the same waterproofing membrane 5A or, in other words, of the same waterproof and flexible sheet.

The lower waterproofing membrane 5A is flexible and waterproof. It may be made of a waterproof elastomeric material, such as Ethylene Propylene Diene Monomer rubber (usually referred to as "EPDM"). It may be of a material similar or identical to the one of the upper waterproofing membrane 34A. The lower waterproofing membrane 35A may have, like the upper waterproofing membrane, a thickness comprised between 0.3 and 2 millimeters.

To fix the lower waterproofing membrane 5A on the assembly of sandwich panels 40A, a part of the lower waterproofing membrane 5A may be pressed against the inner face 32A of the assembly by the lower metallic section 21A of the metal framework 2A. In other words, the lower waterproofing membrane 5A may be sandwiched between the lower metallic section 21A and the inner face 32A of the assembly of sandwiched panels 40A. The lower waterproofing membrane 5A is further fixed on the assembly of sandwich panels 40A by gluing it against the lower part of the inner face 31A of the sandwich panel.

The flap 53A extends beyond the lower edge 33A of the assembly of sandwich panels, over a distance d higher than or equal to the thickness t of the lower edge 33A of the assembly of sandwich panels.

In other words, the ratio between the distance d of the flap 53A and the thickness t of the lower edge 33A of the assembly of sandwich panels is higher than 1. Preferably this ratio is lower than 3.

The thickness t of the lower edge 33A of the assembly of sandwich panels is preferably greater than or equal to 4.0 cm. The thickness t is preferably lower than or equal to 30.0 cm. The thickness t is more preferably comprised between 7.0 cm and 25.0 cm.

Thanks to the wide width d of the flap 53A, when assembling a facade 10 made of several such facade elements, the flap 53A can be arranged so that it extends from the bottom of the inner face of an upper facade element 1C, to the upper part of the outer face of a lower facade element 1A, thus making the junction between these two facade elements 1A, 1C waterproof. Besides, as explained in detail below (when describing such a facade), a flap arranged in this way, allows water, that could have infiltrated the facade, to be efficiently discharged to the outside.

The left lower overhang 51A may extend beyond the left edge 35A of the assembly of sandwich panels 40A over a length comprised between 1 and 7 centimeters, for instance greater than 3 centimeters. The right lower overhang 52A may extend also, beyond the right edge 36A of the assembly of sandwich panels 40A, over a length comprised between 1 and 7 centimeters, typically greater than 3 centimeters. Here, the left and right lower overhangs 51A and 52A have the same length l (which is also the same as the length of the left and right upper overhangs 41A and 42A).

The overhangs 51A, 52A of the lower waterproofing membrane 5A enable two adjacent facade elements to be joined together, in a watertight manner, while maintaining a lateral (horizontal) gap between them, as explained above about the upper overhangs 41A, 42A.

Figure 17:
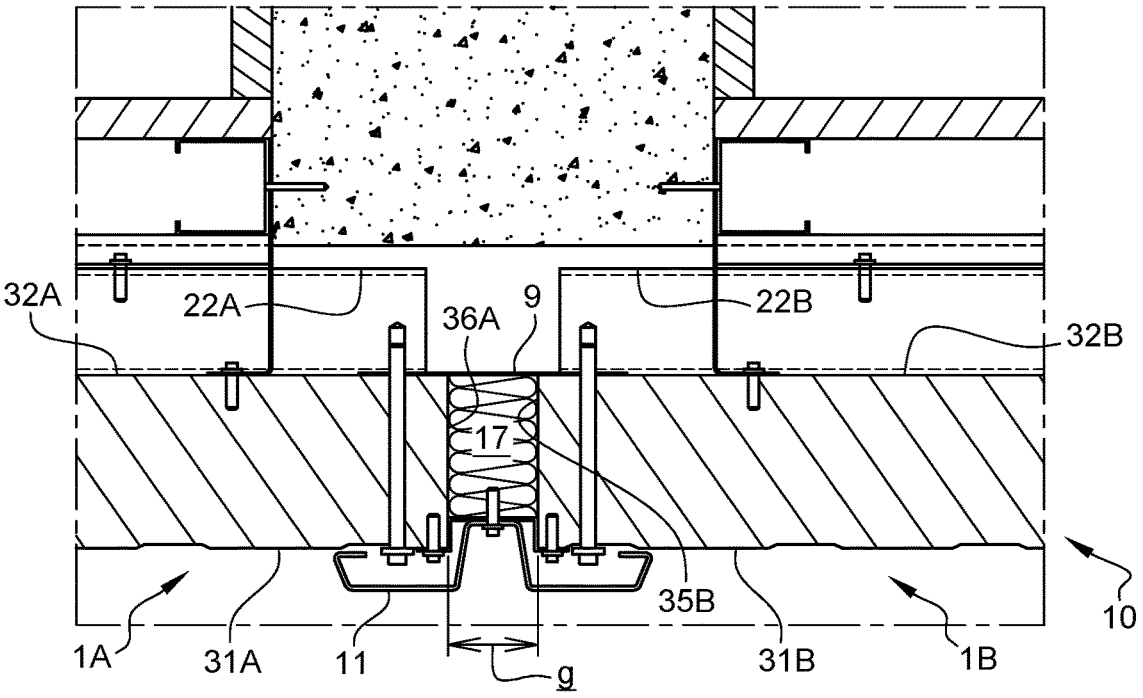
FIG. 17, which is a schematic sectional top view of the building facade of FIG. 16.
Figure 18:
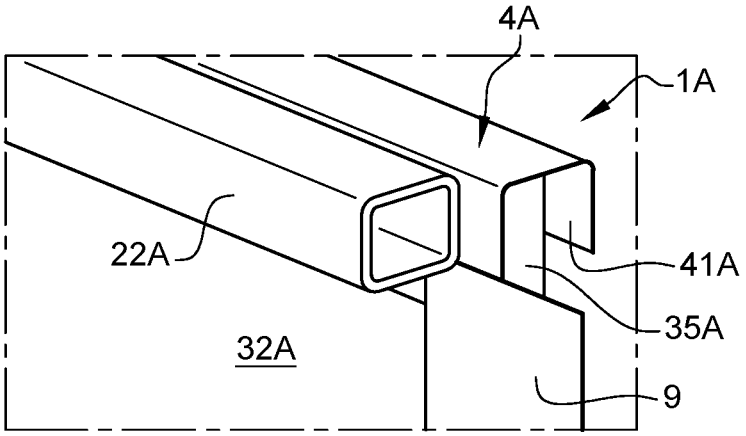
FIG. 18 represent a side waterproofing membrane of the facade element of FIG. 1.

The facade element 1A may be provided also with a side waterproofing membrane 9 fixed, for instance glued, on the inner face 32A of the facade element 1A and extending either on the right side of the facade element 1, beyond its right edge 36A, or on the left side of the facade element 1, beyond its left edge 35A (see FIG. 18; the side waterproofing membrane 9 of the facade element 1A is not represented in FIGS. 6 and 7 for clarity). The side waterproofing membrane 9 is intended to close the lateral gap between two laterally adjacent facade elements 1A, 1B of a building facade. The side waterproofing membrane 9 is configured more precisely to extend from the inner face 32A of one of these two facade elements, to the inner face 32B of the other of these two facade elements, across the lateral gap mentioned above (see, e.g., FIG. 17).

The side waterproofing membrane 9 is substantially rectangular. It extends beyond the right edge 36A (or, alternatively, beyond the left edge) of the facade element, over a length that is greater than the length l of the overhangs 41A, 42A, 51A, 52A, as the side waterproofing membrane 9 is configured to extend up to another adjacent facade element, across the gap maintained between them (see, e.g., FIG. 18). The width of the side waterproofing membrane 9 (that is to say its extent in a direction parallel to the upper or lower edge 33A, 34A of the facade element), may be comprised between 8 and 16 centimeters, for instance. The side waterproofing membrane 9 may be made of the same material than the upper and lower waterproofing membranes 4A, 5A, and may have the same thickness.

The side waterproofing membrane 9 covers up a part of the upper waterproofing membrane 4A, so that they overlap with each other (see FIG. 18). The side waterproofing membrane 9 may be glued over a part of the upper waterproofing membrane 4A that extends below the upper metallic section 22A, and that is located on the right side or, alternatively, on the left side of the facade element 1A. In this regard, it should be noted that the upper waterproofing membrane 4A extends beyond the upper metallic section 22A, towards the lower edge of the facade element, over 2 centimeters at least, preferably over more than 4 centimeters. The side waterproofing membrane 9 and the upper waterproofing membrane 4A thus overlap with each other in a tile-like manner, which provides an improved waterproofing.

The side waterproofing membrane 9 covers up also a part of the lower waterproofing membrane 5A, in a similar manner. The side waterproofing membrane 9 may be glued over a part of the lower waterproofing membrane 5A that extends above the lower metallic section 21A, and that is located on the right side or, alternatively, on the left side of the facade element 1A. In this regard, it should be noted that the lower waterproofing membrane 5A extends above the lower metallic section 21A, towards the upper edge of the facade element, over 2 centimeters at least, preferably over more than 4 centimeters.

The side waterproofing membrane 9 is preferably fixed on the facade element 1A before positioning and fastening the facade element 1A to a building structure (for instance, during the factory assembling of the facade element). It is indeed more convenient and enables a better assembling precision than fixing this side membrane after the facade element had been fastened to the building structure (as some elements of the building structure, like inner walls or pillars, may obstruct the installation of this side membrane). In this case, the side waterproofing membrane 9 may be glued along its entire length on the facade element 1A, its upper and lower parts being thus glued over the upper and lower waterproofing membranes 4A, 5A (as explained above). But the side waterproofing membrane 9 may also be glued on the facade element 1A only along a part of its length, without gluing its upper and lower parts so that other waterproofing membranes can be inserted between the side waterproofing membrane 9 and the upper or lower waterproofing membranes 4A, 5A, during the process of assembling of the building facade.

As represented in FIG. 1, the inner and outer faces 32A, 31A of the assembly of sandwich panels 40A are full, solid, with no aperture. But alternatively, there may be one or more apertures in the facade element, to allow the installation of one or more windows or other opening panels, for instance. These apertures could be equipped with appropriate joinery and/or sealing elements, for instance with window carpentry, so that the facade element, once provided with one or more windows, or doors or other opening panels, remains watertight. The apertures mentioned above could be obtained by cutting up one or several of the sandwich panels of the facade element. The joinery and carpentry mentioned above is typically fixed on the facade element 1 before positioning and fastening the facade element to a building structure (for instance, during the factory assembling of the facade element).

Building Facade

The facade element 1A of FIG. 1, or one of its alternatives mentioned above, can be fastened to the main structure of a building, with other identical or similar facade elements, to build a facade of the building.

Figure 16:
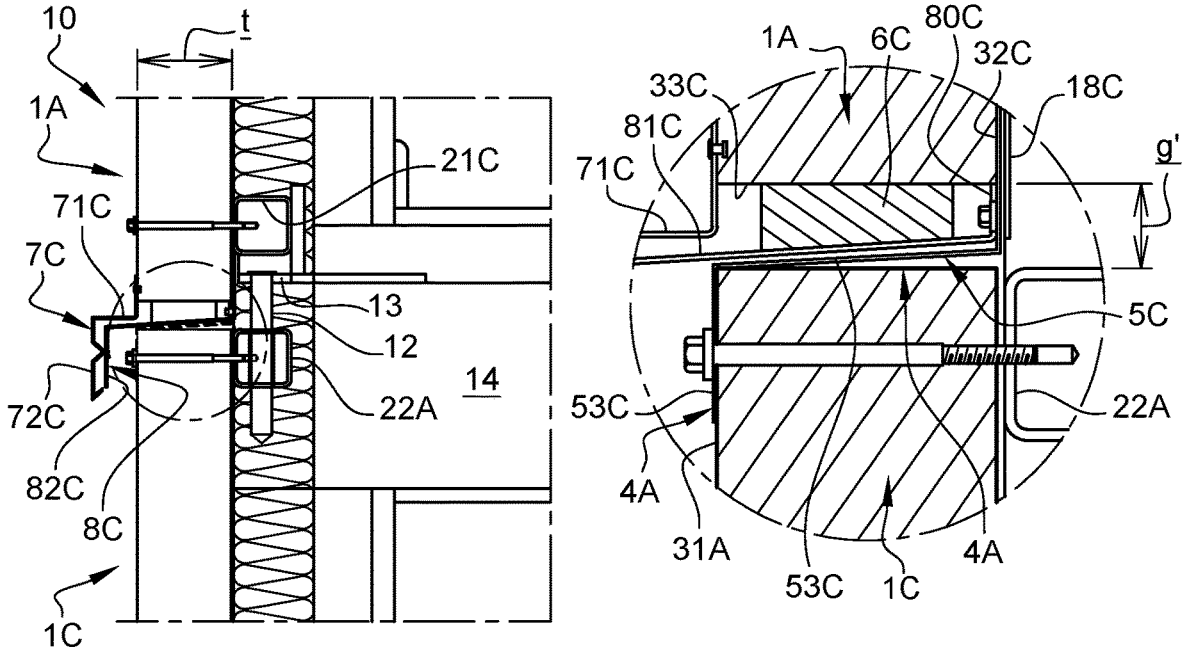
FIG. 16, which is a schematic sectional side view of a building facade that comprises several facade elements such as the one of FIG. 1.

FIGS. 16 and 17 are partial section views of an illustrative embodiment of a such a building facade 10.

This facade 10 comprises at least (FIG. 12):

- two lower facade elements, namely a first facade element 1A and a second facade element 1B, adjacent to each other, and
- two upper facade elements, namely a third facade element 1C, and a fourth facade element 1D, also adjacent to each other, and positioned above the two lower facade elements 1A, 1B.

In this embodiment, the four facade elements 1A, 1B, 1C, 1D are identical, or essentially identical to the facade element 1A of FIG. 1. The identical or corresponding elements of these different facade elements are labeled using the same reference signs, followed respectively by the letters "A", "B", "C" and "D" (for instance, the upper edges of the respective assemblies of sandwich panels of these four facade elements are labeled using the following reference signs: 34A, 34B, 34C and 34D, respectively).

This exemplary embodiment will allow one to understand the specific technique employed, according to the invention, to join together different facade elements of a same facade, in a watertight manner. As the skilled person will appreciate, this technique can be applied to build facades having a number of facade elements different than four (in particular higher than four), or to build facades made of facade elements different from the one represented in FIG. 1 as long as the facade elements employed are still provided with an upper and a lower waterproofing membrane like the ones described above.

In this embodiment, the second facade element 1B is positioned on the right of the first facade element 1A. So, the right edge 36A of the first facade element 1A faces the left edge 35B of the second facade element 1B, these two edges 36A, 35B being parallel to each other (see FIGS. 12 and 17).

The third facade element 1C is positioned above the first facade element 1A. The lower edge 33C of the third facade element 1C faces the upper edge 34A of the first facade element 1A, these two edges being parallel to each other.

The fourth facade element 1D is positioned above the second facade element 1B, and on the right of the third facade element 1C. The lower edge 33D of the fourth facade element faces the upper edge 34B of the second facade element 1B, these two edges 33D, 34B being parallel to each other. And the left edge 35D of the fourth facade element 1D faces the right edge 36C of the third facade element 1C, these two edges 35D, 36C being parallel to each other.

The four facade elements 1A, 1B, 1C and 1D are slightly spaced apart from each other: the assemblies of sandwich panels of these different facade elements do not come into contact with each other.

More precisely, the right edges 36A, 36C of the left facade elements 1A and 1C are separated from the left edges 35B, 35D of the right facade elements 1B and 1D, respectively, by a lateral gap g (see FIG. 17). This gap g may be comprised between 1 and 10 centimeters. It is preferably greater than 2, or even 4 centimeters. Here, the lateral gap g is equal to the length l of the overhangs 41A, 51A, 42B, . . . of the waterproofing membranes 4A, 4B, 5C, 5D of the facade elements (still, the gap g could alternatively be possibly slightly higher than said length l).

Maintaining such a lateral spacing between adjacent facade elements (i.e.: having this lateral gap g) makes the assembling of the facade easier than the assembling a gap-less structure, as it provides a greater freedom regarding the positioning of the facade elements on the building (in other words, it allows higher, less stringent mechanical tolerances than with a gap-less structure). Besides, having a gap that wide makes the filling of the gap with insulating material easier, and enables the waterproofing membranes of the various facade elements to overlap with each other over a wide area, at the junction between adjacent facade elements.

The lower edges 33C, 33D of the upper facade elements 1C, 1D are separated from the upper edges 34A, 34B of the lower facade elements 1A, 1B by a vertical gap g' (see FIG. 16). The vertical gap g' may be comprised between 1 and 5 centimeters, for instance. It is preferably higher than 2 centimeters. Maintaining this vertical gap provides the same benefits as maintaining the lateral gap mentioned above.

The junction and waterproofing between laterally adjacent facade elements (that is to say between the first and second facade elements 1A, 1B, or between the third and fourth facade elements 1C, 1D) will be presented first.

The junction and waterproofing between facade elements placed one above the other (for instance between the first and third facade elements 1A and 1C) will be presented in a second step.

Figure 9:
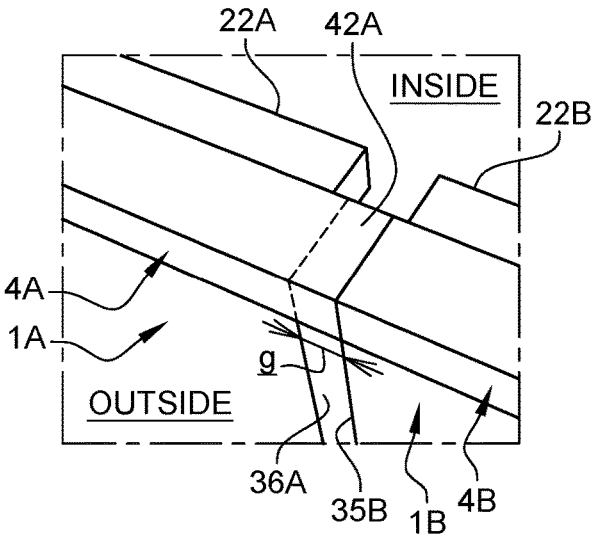

As represented in FIG. 9, the right upper overhang 42A of the first facade element 1A and the left upper overhang 41B of the second facade element 1B overlap at least partially each other. Here, the lateral gap g equals the length l of these overhangs, and these two overhangs thus overlap completely each other (they overlap each other over their entire extent). The left upper overhang 41B is in contact with the right upper overhang 42A. They are even preferably glued together. Here, the right upper overhang 42A overlaps the left upper overhang 41B and covers up the left upper overhang 41B. Alternatively, the left upper overhang 41B overlaps the right upper overhang 42A and covers up the right upper overhang 42A.

The waterproofing upper membranes 4A and 4B are thus joined to each other, in a watertight manner, in spite of the lateral gap g, to form a kind of continuous, longer membrane extending along the facade 10.

The lateral gap g between the first and second facade elements 1A, 1B is closed, on the inner side of the facade, by a first side waterproofing membrane, namely by the side waterproofing membrane 9 that has been described above, (which has been preferably fixed on the first facade element 1A during its factory assembling, prior to its positioning on the building). The first side waterproofing membrane 9 is fixed to the right edge of the first facade element 1A as described above, when presenting the facade element 1A itself. On the other side of the lateral gap, the first side waterproofing membrane 9 is fixed to the second facade element 1B. The first side waterproofing membrane 9 is more precisely glued on the inner face 32B of the second facade element, in the vicinity of its left edge 35B. The top of the first side waterproofing membrane 9 overlaps with a part of the upper waterproofing membrane 4B of the second facade element 1B, just like it overlaps with a part of the upper waterproofing membrane 4A of the first facade element 1A (this last overlapping having been described above when presenting the facade element 1A). And, similarly, the bottom of the first side waterproofing membrane 9 overlaps with a part of the lower waterproofing membrane 5B of the second facade element 1B.

Here, the lateral gap between the adjacent facade elements 1A and 1B is filed with an insulating material 17, for instance with some mineral wool (see FIG. 17).

The lateral gap is closed, on the outer side of the facade, by a profiled member 11 extending from the outer face 31A of the first facade element to the outer face 31B of the second facade element (see FIG. 17).

Like for the first and second facade elements, the right upper overhang 41C of the third facade element 1C and the left upper overhang 41D of the fourth facade element 1D overlap at least partially each other. Here, they overlap completely each other. They are in close contact with each other. Here, they are even preferably glued to each other.

Figure 11:
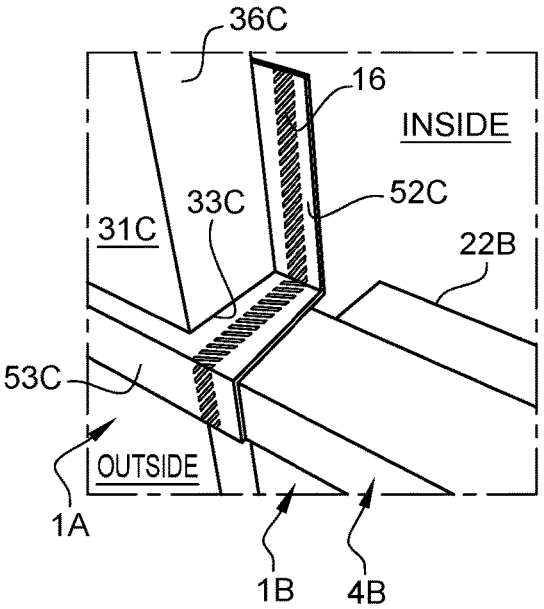
Figure 12:
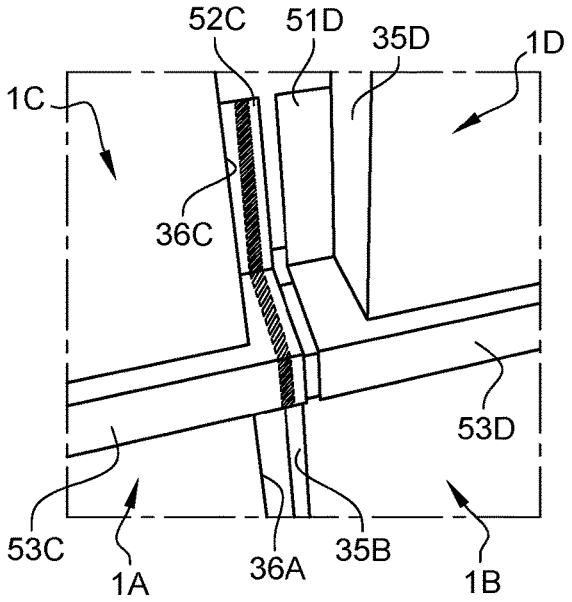
Figure 13:
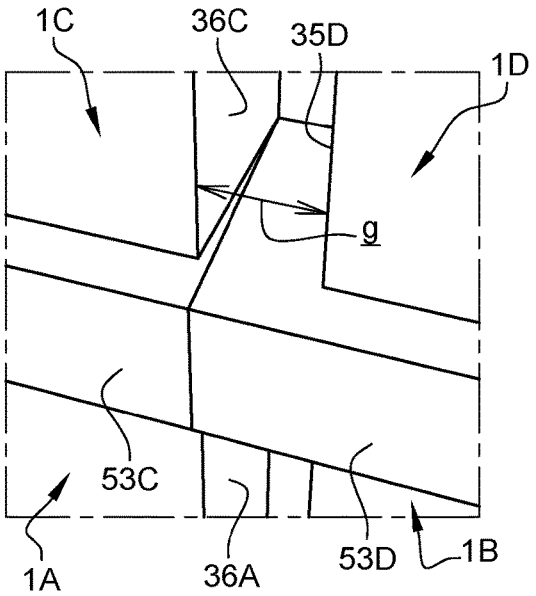
Figure 14:
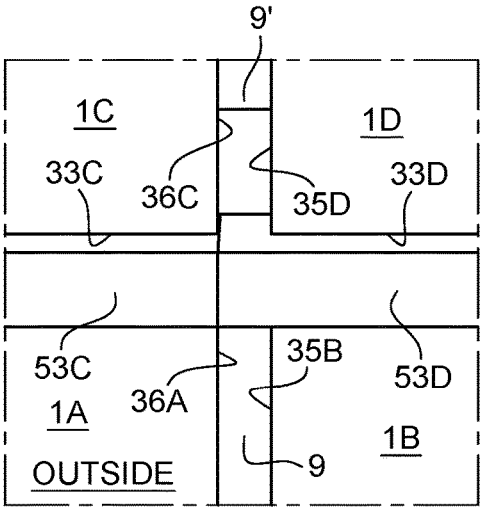

As represented in FIGS. 11 to 13, the lower waterproofing membranes 5C and 5D are also joined to each other in a watertight manner, thanks to their overhanging parts 52C, 51D, to form a kind of continuous, longer membrane extending along the facade 10.

More precisely, the right lower overhang 52C of the third facade element 1C and the left lower overhang 51D of the fourth facade element 1D overlap each other (here, they overlap completely each other). These two overhangs 52C, 51D are in close contact with each other. They are glued together (the glue 16 employed to glue them together is represented in FIGS. 11 and 12 by hatching). Here, the left lower overhang 51D of the fourth facade element 1D overlaps the right lower overhang 52C of the third facade element 1C. Alternatively, the right lower overhang 52C of the third facade element 1C could overlap the left lower overhang 51D of the fourth facade element 1D.

Like for the first and second facade elements 1A, 1B, the lateral gap between the third and fourth facade elements 1C, 1D is closed, on the inner side of the facade, with a second side waterproofing membrane 9', identical (or at least similar) to the first side waterproofing membrane 9.

Figure 15:
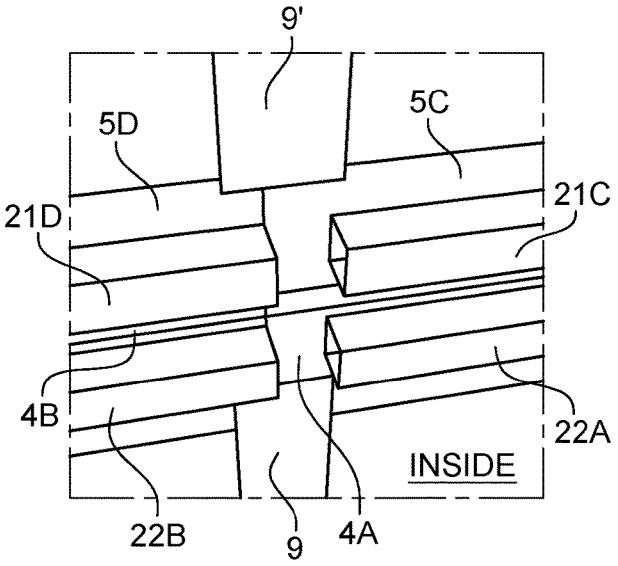

The second side waterproofing membrane 9' is attached, here glued, on the inner faces 32C, 32D of both the third and fourth facade elements 1C, 1D (see FIG. 15). According to one variant, this second side waterproofing membrane 9' is attached partially on the upper and lower waterproofing membranes 4C, 4D, 5C, 5D of the facade elements 1C, 1D joined by this second side waterproofing membrane 9', like explained above for the first side waterproofing membrane 9.

Consequently, when the side waterproofing membrane 9' is fixed on the right edge 36C of the facade element 1C during its factory assembling, the left lower overhang 51D of the fourth facade element 1D overlaps the right lower overhang 52C of the third facade element 1C. Symmetrically, when the side waterproofing membrane 9' is fixed on the left edge 35D of the facade element 1D during its factory assembling, the right lower overhang 52C of the third facade element 1C overlaps the left lower overhang 51D of the fourth facade element 1D.

Alternatively, the second side waterproofing membrane 9' is attached on the inner faces 32C, 32D without being attached to the upper and lower waterproofing membranes 4C, 4D, 5C, 5D. In that case, there is no restriction on how the lower overhangs overlap each other.

On the outer side of the facade, the lateral gap between the third and fourth facade elements 4C, 4D is closed by a profiled member 11 extending from the outer face 31C of the third facade element to the outer face 31D of the fourth facade element (like the lateral gap between the first and second facade element). This lateral gap too is filed with an insulating material, for instance with some mineral wool.

Now that the waterproofing between laterally adjacent facade elements has been described, the junction and waterproofing between facade elements placed one above the other can be presented.

This later waterproofing is achieved, inter alia, by means of the two lower waterproofing membranes 5C and 5D of the upper facade elements 1C and 1D.

Figure 24:
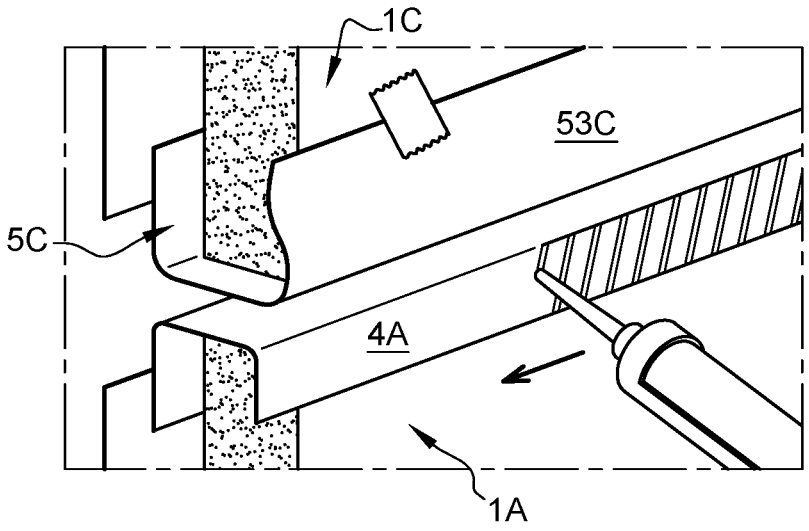
Figure 25:
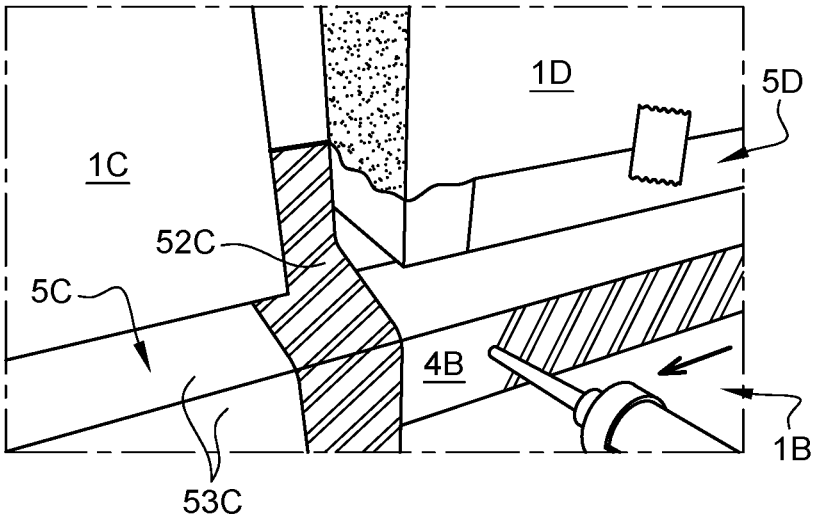

When installing the upper facade element 1C on the building structure, one folds the lower waterproofing membrane 5C to bring the flap 53C of this membrane close to the lower edge 33C of this facade element (to maintain the flap 53C in this position, the lower end of the flap may be temporarily fixed to the outer face of the facade element 1C using adhesive tape, for instance, see FIGS. 24 and 25). The third facade element 1C in then placed in its final position on the building structure and fastened to it. And then, the part of flap 53C that extend outside the facade is folded down on the upper part of the outer face of the lower facade element 1A.

So, once the facade 10 is assembled, the flap 53C of the lower waterproofing membrane 5C extends from the inside of the facade, to its outside. The flap 53C extends more precisely from the inner face 32C of the third facade element 1C, to the outer face 31A of the first facade element 1A (the lower waterproofing membrane 5C having then the shape of a kind of stair step, or the shape of a kind of slide directed downwards, and towards the outside of the facade). This configuration allows water, that could have infiltrated the facade, to be efficiently discharged to the outside.

Besides, the flap 53C is put in contact with a part of the upper waterproofing membrane 4A of the first facade element, all along this membrane 4A, and covers up this part of the upper waterproofing membrane 4A, thus joining the third facade element 1C and the first facade element 1A in a particularly watertight manner. More precisely:

the part of the flap 53C that extends on the outer face 31A of the first facade element 1A, and the part of the upper waterproofing membrane 4A that extends on the outer face 31A of the first facade element 1A overlap completely each other (they are superimposed on each other over their entire respective extent) and are glued together.

Joining the lower waterproofing membrane 5C with the upper waterproofing membrane 4A in this way, on the outer side of the facade (by gluing them together), is much more convenient than joining them on the inner side of the facade. Indeed, on the inner side of the facade, the concrete slab 14' to which the first and third facade elements 1A, 1C are fastened prevents access to the gap that separates these two facade elements (see FIG. 16).

To further protect the facade 10 from rain and runoffs, a longitudinal, rain protective profiled lid 7C is fastened to a bottom part of the outer face 31C of the third facade element 1C (see FIG. 16).

The rain protective profiled lid 7C extends longitudinally along the lower edge 33C of the third facade element 1C. This rain protective profiled lid is fastened, for instance by means of screws, to the bottom part of the outer face 31C and it extends outwardly and downwardly from the outer face 31C, beyond the lower edge 33C of the third facade element 1C. The rain protective profiled lid 7C thus prevents rainwater from entering the space that extends between the lower facade element 1A and the upper facade element 1C.

As represented in FIG. 16, the rain protective profiled lid 7C is fastened directly to the outer face 31C of the third facade element 1C. Still, in other embodiments, the rain protective profiled lid could be fastened to additional equipment such as an outer cladding, which, in turn, is fastened to the outer face of the assembly of sandwich panels of the facade element (in which case the rain protective profiled lid is still fastened to the outer face of the facade element, but non-directly).

The rain protective profiled lid 7C may be obtained, like here, by bending and stamping, from a metallic sheet. The rain protective profiled lid 7C may comprise successive sheet portions (each portion being substantially plane), namely:

an overhanging portion 71C, extending from the bottom part of the outer face 31C, towards the outside of the building, substantially horizontally;

a folded portion 72C, extending downwardly, substantially vertically, from the outer end of the overhanging portion 71C to a lower, free end of the rain protective profiled lid 7C.

As represented in FIG. 16, the facade 10 preferably comprises also fire deflectors 8C, 8D, each extending across the gap that separates the lower facade elements 1A, 1B from their upper counterpart 1C, 1D. Each deflector may be made, like here, of a formed metallic sheet. It is fastened to the inner face 32C, 32D of the upper facade element considered, at the bottom of it, preferably on a mounting angle 18C attached on the underside of the metal framework 2 (see FIG. 10). It extends across said gap, up to the outside of the assembly of sandwich panels.

Here, each fire deflector 8C comprises:

a first portion 81C, extending horizontally, or in slightly slanted way, from the bottom of the inner face 32C, 32D of the facade element considered, to the outside of the assembly of sandwich panels of the facade element 1C, a second portion 82C, extending downwardly, substantially vertically, from an outer end of the first portion 81C, to a lower, free end of the fire deflector 8C, and a fixing bracket 80C, extending upwardly, substantially vertically, from an inner end of the first portion 81C.

The fixing bracket 80C is fastened, for instance bolted, to the mounting angle 18C.

The lower, free end of the second portion 82C of the fire deflector 8C is preferably supported by a folded rim made at the lower, free end of the folded portion 72C of the rain protective profiled lid 7C. Each of the upper facade elements 1C, 1D is preferably isolated, along its entire length (that is to say all along its lower edge), from its lower counterpart 1A, 1B, by one or more of these fire deflectors 8C, 8D. Each of these fire deflectors may extend all along the corresponding facade element, or along just a part of this facade element (in this last case, several fire deflectors are provided to each facade element, to isolate the two facade elements from each other over their entire length).

As represented in FIG. 16, a compressible strip, for instance a watertight compressible strip may also be arranged below the facade element 1C, along at least a part of the lower edge 33C of the assembly of sandwich panels of this facade element, for instance in contact with this lower edge. This compressible strip 6C may be used as a thermal insulation, to fill the vertical gap maintained between two facade elements 1A, 1C placed one above the other. The compressible strip may be a closed-cell plastic foam seal, for instance (like a closed-cell polyvinyl chloride foam seal). The compressible strip 6C is typically arranged on the facade element 1A after the facade element has been positioned and fastened to a building structure. The compressible strip 6C may be made in one piece, or it may comprise several shorter sections, to facilitate its insertion between the two facade elements 1A, 1C in question (see FIG. 30 and strips 6D described below, for instance).

In addition to such compressible strips, the facade elements could be provided with other additional equipment, fixed on the outer side of the facade element considered, such as outer claddings.

As explained above, the rain protective profiled lid 7C participates to the waterproofing of the facade. The protection of the building against rain and runoff water is thus achieved by means of two different barriers:

a first barrier, constituted by the rain protective profiled lids, that are fastened to the bottom of the facade elements, and a second barrier, constituted by the different waterproofing membranes (namely the upper, lower and vertical waterproofing membranes), which make the inner face of the facade 10 watertight and airtight.

The first barrier is not airtight: it allows air communication between the outside and the space between the lower facade element 1A and the upper facade element 1C. And these two barriers are slightly spaced from each other.

Indeed, the vertical gap g' is high enough that the fire deflector 8C does not come into contact with the lower facade element 1A. The fire deflector 8C is thus spaced apart from the upper edge 34A of the first facade element.

The space thus provided between these elements plays the role of a pressure balancing chamber, enabling to balance the pressure of air on the inner side of the facade, and the pressure of air on the outer side of the facade.

The junction and waterproofing between the second facade element 1B and the fourth facade element 1D is identical, or at least similar to what has be presented just above for junction of the first facade element 1A with the third facade element 1C.

Figure 10:
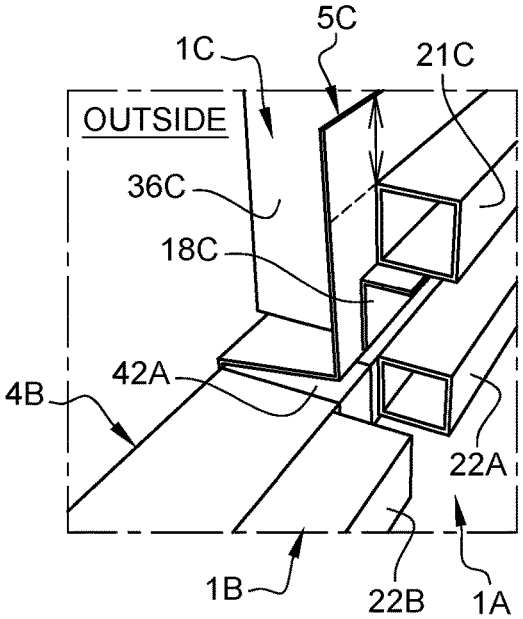

The kind of junction node, where the four facade elements 1A, 1B, 1C and 1D are joined to each other, is set up so that the waterproofing membranes 4A, 4B, 5C, and 5D overlap in a tile-like arrangement. As presented on FIGS. 8 to 12; the tile-like arrangement can be as follows:

The right upper overhang 42A covers up the left upper overhang 41B (FIG. 9), The right lower overhang 52C then covers up the right upper overhang 42A, as represented in FIGS. 10 and 11 (and so, the right lower overhang 52C covers up also the left upper overhang 41B), And, finally, the left lower overhang 51D covers up the right lower overhang 52C (and so, it covers up also the right upper overhang 42A and the left upper overhang 41B, see FIGS. 12 and 13).

Regarding the first and second side waterproofing membranes 9 and 9', their upper and lower parts cover up the upper, and lower waterproofing membranes respectively, as already described.

This overall tile-like arrangement contributes to an efficient waterproofing of the node in question.

This tile-like arrangement is the one implemented when the side waterproofing membrane 9 is fixed on the right edge 36A of the first facade element 1A during its factory assembling (before fastening the facade elements to the building structure) and is fixed partially on the upper and lower waterproofing membranes (glued over a part of the upper and over a part of the lower waterproofing membranes, for instance). This tile-like arrangement is thus the one implemented when the side waterproofing membrane 9 is prefixed along its entire length on the inner side 32A of the facade element 1A. In this case, it is this tile-like arrangement that is implemented because the left upper overhang 41B could not be arranged over the right upper overhang 42A. Indeed, this would require inserting the left upper overhang 41B between the right upper overhang 42A and the side waterproofing membrane 9 while these two last membranes are glued together. Similarly, the right lower overhang 52C could not be arranged over the left lower overhang 51D, as the side waterproofing membrane 9 is glued, over its entire length, on the right side of the facade element 1A. In an alternative embodiment, the detailed sequence of this tiling can be different:

the left upper overhang 41B covers up the right upper overhang 42A, the left lower overhang 51D then covers up the left upper overhang 41B, and the right lower overhang 52C covers up the left lower overhang 51D.

This tile-like arrangement is the one implemented when the side waterproofing membrane 9 is fixed on the left edge 35 of the first facade element 1 during its factory assembling and is fixed partially on the upper and lower waterproofing membranes (glued over a part of the upper and over a part of the lower waterproofing membranes, for instance).

When the side waterproofing membrane 9 is not fixed on the upper and lower waterproofing membranes or not fixed on one edge of the first facade element 1 during its factory assembling, other tile-like arrangements than the ones described above can be implemented. In particular, the two tile-like arrangements described above can be mixed. In this case, the different waterproofing membranes may overlap each other so that:

the left lower overhang 51D of the fourth facade element 1D covers up the right lower overhang 52C of the third facade element 1C, the right lower overhang 52C of the third facade element covers up the left upper overhang 41B of the second facade element 1B, and the left upper overhang 41B of the second facade element covers up the right upper overhang 42A of the first facade element 1A, or, alternatively, so that the right lower overhang 52C of the third facade element 1C covers up the left lower overhang 51D of the fourth facade element 1D, the left lower overhang 51D of the fourth facade element 1D covers up right upper overhang 42A of the first facade element 1A, and the right upper overhang 42A of the first facade element covers up the left upper overhang 41B of the second facade element 1B.

These last two tile-like arrangement enable a very efficient waterproofing of the junction between the four facade elements 1A, 1B, 1C, 1D, as a left to right alternance is observed each time a membrane is added over the others.

The facade elements 1A, 1B, 1C, 1D are fastened to the building structure by means of their respective metal frameworks, more specifically by mean of their lower 21A, 21B, 21C, 21D and upper 22A, 22B, 22C, 22D metallic sections.

The concrete slabs 14, 14' of the building are equipped with mounting plates 13, fastened to the slab, that protrudes from these slabs 14, 14', towards the outside of the building (FIG. 16). The lower metallic section of a given facade element (for instance the lower metallic section 21C of the third facade element 1C, see FIG. 16) rests on at least two such mounting plates 13, which support the facade element. And the upper metallic section of the facade element is linked to mounting plates protruding from the slab 14' of the above floor, this connection being achieved by means of metallic axes, here. Each of these axes extends substantially vertically and passes through one of the mounting plates, and then through corresponding holes of the upper metallic section of the facade element (see the metallic axis 12 of FIG. 16, for instance, which retains the upper part of the first facade element 1A). The upper end of the axis comprises a flange, which is sandwiched between the mounting plate 13 itself and a metallic section of another facade element placed above (and supported by this mounting plate), which secure the metallic axis in question.

Process for Assembling a Building Facade

A way to assemble facade elements, like the one of FIG. 1, in order to build a building facade according to the invention, is described below.

A building facade made of facade elements according to the invention, like the one of FIG. 1, is assembled from bottom to top (for instance floor by floor).

The lowest floor to be provided with facade elements, for instance the ground floor, is first equipped, at least partially, with the facade elements to be fastened between this lowest floor and the floor above (to provide the ground floor with an external wall). Once the lowest floor has be provided with at least two laterally adjacent facade elements, the assembling of the facade may continue on the floor above, by positioning and fastening to the building two or more upper facade elements each positioned above one of the facade elements of the floor below.

The lowest floor in question may be fully equipped with facade elements before starting to provide the floor above with facade elements. Or, alternatively, the assembling of facade elements on floor above may start when at least two adjacent facade elements have been installed on the lowest floor, even if the lowest floor is not fully equipped. In this case, the building of the facade may then continue in parallel on the lowest floor and on the floor above.

FIGS. 19 to 31 represent different steps of an assembling of four adjacent facade elements, that enable to obtain a facade like the one that has been described in detail above. This facade comprises:

two lower facade elements, namely a first facade element 1A and a second facade element 1B, laterally adjacent to each other, and two upper facade elements, namely a third facade element 1C, and a fourth facade element 1D, also laterally adjacent to each other, and positioned above the two lower facade elements 1A, 1B.

These first, second, third and fourth facade elements 1A, 1B, 1C, 1D are identical, or at least similar to the ones that have been described above. They comprise openings (windows and/or entrance doors). Apart from their openings, these four facade elements 1A, 1B, 1C, 1D are identical to each other. These facade elements and their different parts will be referred to using the same reference signs as before (for instance, their respective upper waterproofing membranes will be referred to as 4A, 4B, 4C and 4C, as before). Each of these facade elements 1A, 1B, 1C, 1D is provided with the side waterproofing membrane 9, 9' that has been described above. As represented in FIGS. 18 to 23, each side waterproofing membrane 9, 9' is attached on the left side of the corresponding facade element 1A, 1B, 1C, 1D, here. The side waterproofing membrane 9, 9' is attached to the corresponding facade element before fastening this facade element onto the building structure (the membrane is attached during the factory assembling of the facade element). Here, the side waterproofing membrane 9, 9' is attached on the inner face of the facade element 1A, 1B, 1C, 1D without being attached to the upper and lower waterproofing membranes of this facade element.

As the skilled person will appreciate, the assembling technique described below, with reference to FIGS. 19 to 31, can be applied to build facades having a different number of facade elements than in FIGS. 19 to 31 (in particular, with more than two facade elements for each floor), or may comprise a different number of steps (in particular additional steps not described here), or steps arranged according to a different assembling sequence.

The assembling process of FIGS. 19 to 31 starts by a step of positioning the first facade element 1A on the building structure 15 and fastening it to this structure (see FIG. 19). The first facade element 1A is fastened to this structure as explained above: its lower metallic section 21A is supported by (rest on) the mounting plates 13 that are fixed to the ground-floor concrete slab 14 of the building, while its upper metallic section 22A is retained to the building thanks to the metallic axis 12 (see, e.g. FIG. 16) that passes through the mounting plates 13 fixed to the first-floor concrete slab 14'.

The second facade element 1B is then positioned on the right of the first facade element 1A (FIG. 20) and fastened to the building structure 15 using the same fastening technique as for the first facade element. The second facade element 1B is positioned more precisely with its left edge 35B facing the right edge 36A of the first facade element 1A, these two edges 36A, 35B being parallel to each other, and separated by the lateral gap g mentioned above.

Figure 21:
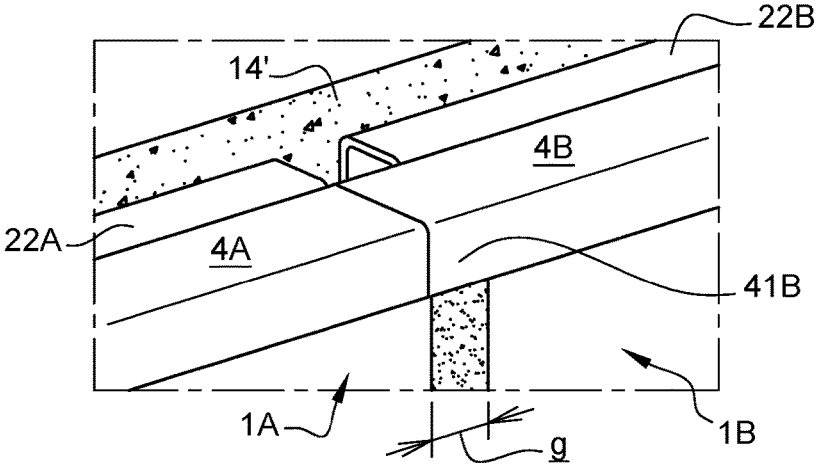

The left upper overhang 41B of the upper waterproofing membrane 4B of the second facade element 1B is then placed over the right upper overhang 42A of the upper waterproofing membrane 4A of the first facade element 1A and glued to it (FIG. 21).

Then, the first side waterproofing membrane 9, that comes already mounted (glued) on the inner face 32B of the second facade element 1B, on its left side, is deployed and glued against the inner face 32A of the first facade element 1A (on the right side of this face 32A), to close the back of the lateral gap between these two facade elements 1A, 1B in a watertight manner, as explained before (see also FIG. 14).

Figure 22:
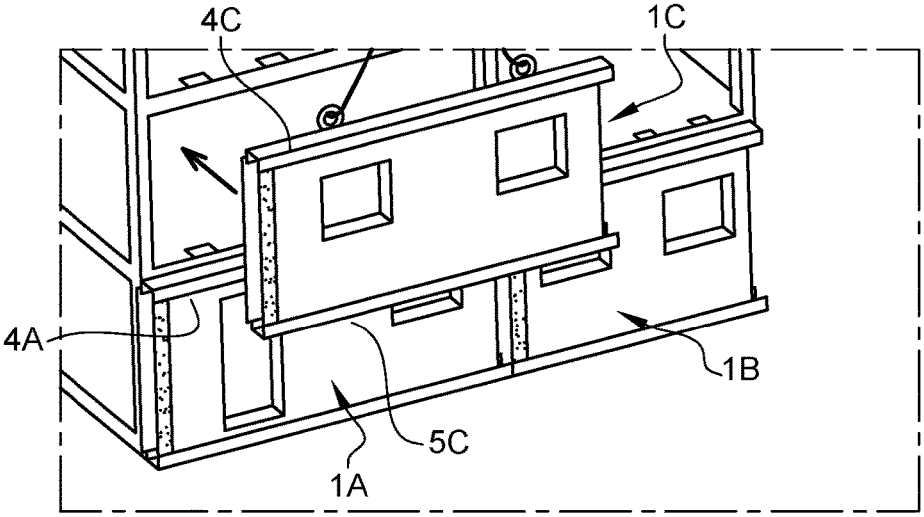

The third facade element 1C is then positioned above the first facade element 1A, and fastened to the building structure 15, using the same fastening technique as before (FIG. 22). The lower metallic section 21C of the third facade element 1C rests on mounting plates 13 that protrude from the first-floor slab 14'. And its upper metallic section 22C is linked to mounting plates 13 fixed to a second-floor slab using metallic axis passing through holes made in the upper metallic section 22C, like explained above.

The third facade element 1C is positioned with the lower edge 33C of the third facade element 1C facing the upper edge 34A of the first facade element 1A, these two edges being parallel to each other, and being separated by the vertical gap g' mentioned above. Here, the third facade element 1C is aligned vertically with the first facade element 1A: the left edge 35C of the third facade element 1C is located in the extension of the left edge 35A of the first facade element 1A, vertically above it (vertically aligned with it), and so it is for the left edges 36A, 36C of these two facade elements. As the skilled person may appreciate, the third facade element may alternatively be positioned over the first facade element while being laterally offset (in which case its left edge 35C is not aligned with the left edge 35A of the first facade element 1A).

Figure 23:
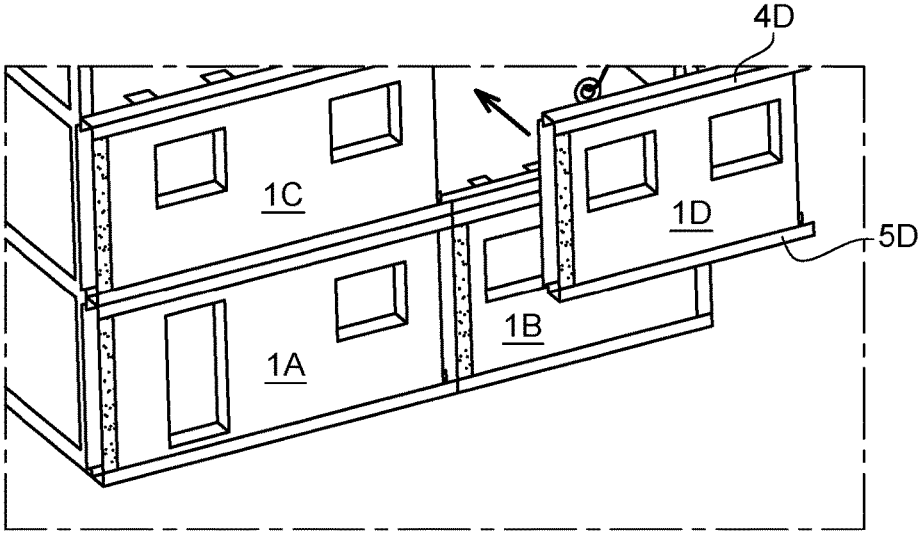

The fourth facade element 1D is then positioned above the second facade element 1B and fastened to the building structure 15 using the same fastening technique as before (FIG. 23).

The fourth facade element 1D is positioned with its lower edge 33D facing the upper edge 34B of the second facade element 1B, these two edges 33D, 34B being parallel to each other, separated by the vertical gap g'. The fourth facade element 1D is aligned vertically with the second facade element 1B. The fourth facade element 1D is positioned with its left edge 35D facing the right edge 36C of the third facade element, these two edges being parallel to each other, separated by the lateral gap g.

Then, the flap 53C of the lower waterproofing membrane 5C of the third facade element 1C (which was, until then, attached to the outer face of the third facade element 1C, using tape) is folded down onto the outer face 31A of the first facade element 1A (FIG. 24). It is more precisely folded down onto the part of the upper waterproofing membrane 4A of the first facade element 1A that extends on the outer face 31A of this facade element, and it is glued to this part of the upper waterproofing membrane 4A, all along the facade element 1A.

Figure 26:
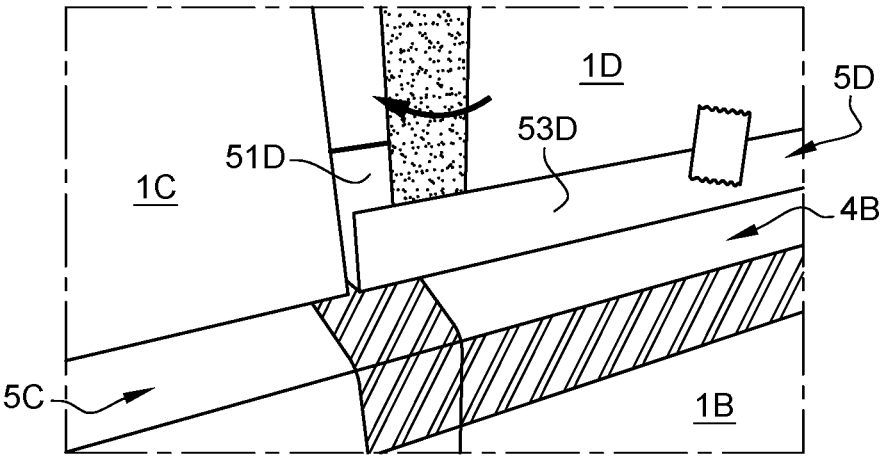

Then, the left lower overhang 51D of the lower waterproofing membrane 5D of the fourth facade element 1D is placed over the right lower overhang 52C of the lower waterproofing membrane 5C of the third facade element 1C and glued to it (FIGS. 25 and 26).

Figure 27:
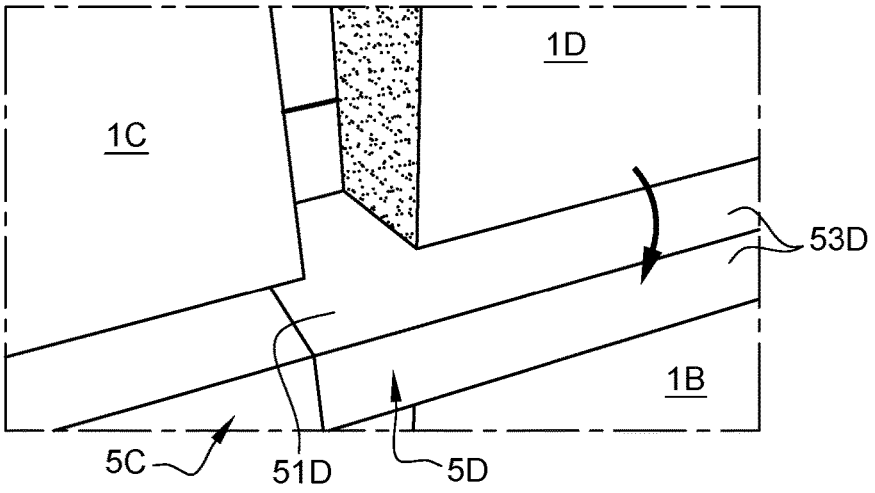
Figure 28:
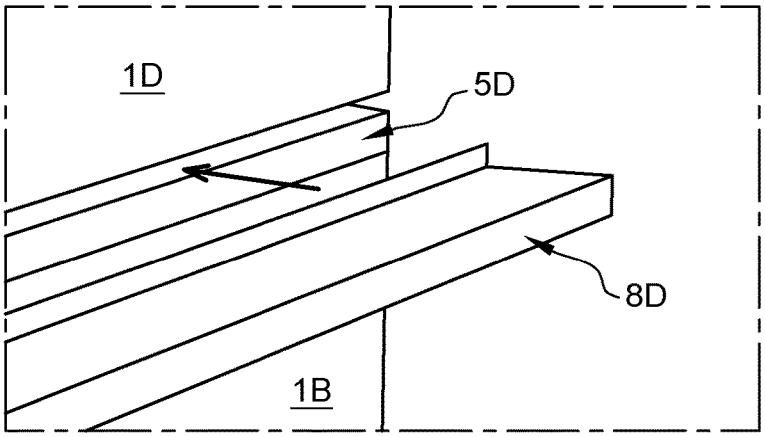

The flap 53D of the lower waterproofing membrane 5D is then folded down onto the outer face 31B of the second facade element 1B (FIG. 27). It is more precisely folded down onto the part of the upper waterproofing membrane 4B of the second facade element 1B that extends on the outer face 31B of this facade element and glued to this part of the upper waterproofing membrane 4B, all along the facade element 1B.

Then, the second side waterproofing membrane 9', that comes already mounted (glued) on the inner face 32D of the fourth facade element 1D, on its left side, is deployed and glued against the inner face 32C of the third facade element 1C (on the right side of this face 32C), to close the back of the lateral gap between these two facade elements 1C, 1D in a watertight manner.

The fire deflectors 8C, 8D are then inserted in the vertical gap that separates the upper facade elements 1C, 1D from the lower facade elements 1A, 1B (FIGS. 28 and 29), and fastened to the inner faces of the upper facade elements 1C, 1D.

Figure 29:
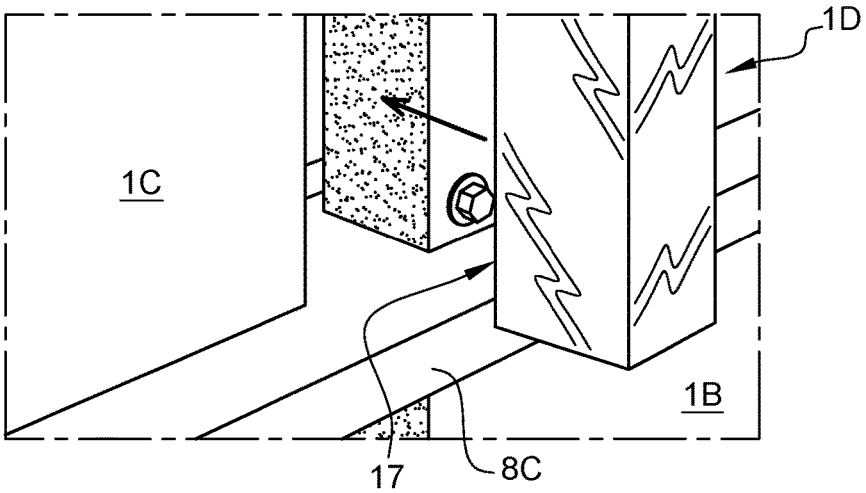

The insulating material 17 is then inserted in the lateral gaps that separate the left facade elements 1A, 1C from the right facade elements 1B, 1D (FIG. 29).

Figure 30:
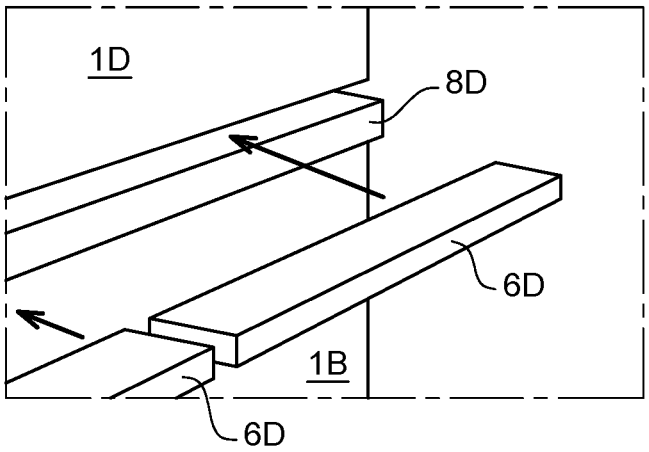

Afterwards, or simultaneously or before, the compressible strips 6D, 6C (see, e.g., FIGS. 30 and 16) are inserted in the vertical gaps mentioned above, between the fire deflectors 8C, 8D and the lower edges 33C, 33D of the upper facade elements 1C, 1D (FIG. 30).

Figure 31:
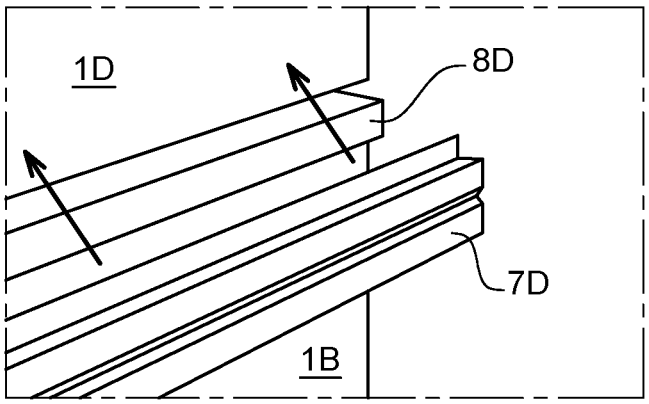

The rain protective profiled lids 7C, 7D are then fastened on the outer faces 31C, 31D of the upper facade elements, along the lower end of these faces 31C, 31D (FIG. 31).

As the skilled person will appreciate, the different steps described above could be executed in a different order.

For instance, the flap 53C of the lower waterproofing membrane 5C of the third facade element 1C could be deployed and fixed to the upper waterproofing membrane 4A of the first facade element 1A before fastening the fourth facade element on the building structure (instead of gluing these two membranes together after the fourth facade element had been fastened to the building structure). Similarly, the first side waterproofing membrane 9 could be fixed to the first facade element 1A after having positioned and fastened the two upper facade elements 1C, 1D, instead of doing it before.

Besides, in the exemplary assembling process described above, the first facade element 1A is first fastened to the building structure, and then, the second facade element 1B is positioned on the right side of the first facade element 1A and fastened to the building structure. But alternatively, the second facade element could also be fastened first to the building structure, the rest of the assembling process remaining unchanged.

It would also be possible to fasten the facade elements in the following order:

first, the second facade element 1B, then, the first facade element 1A (on the left of the second facade element 1B), then, the fourth facade element 1D (above the second facade element 1B), and and then the third facade element (on the left of the fourth facade element 1D).

What is claimed is:

1. A facade element comprising:

a metal framework including at least two longitudinal metallic sections and two transverse metallic sections assembled together to define a rectangle;

an assembly of sandwich panels, each of the sandwich panels including an insulation material sandwiched between an inner metallic sheet and an outer metallic sheet, each of the sandwich panels being fastened to the metal framework and interlocked with at least one adjacent sandwich panel of the sandwich panels along at least a part of one edge so that the assembly is delimited by an outer face, an inner face, a lower edge, an upper edge, a left edge and a right edge;

an upper waterproofing membrane covering the upper edge of the assembly of sandwich panels and extending on both at least an upper part of the outer face and at least an upper part of the inner face, the upper waterproofing membrane including a left upper overhang extending beyond the left edge and a right upper overhang extending beyond the right edge;

a lower waterproofing membrane extending along the lower edge of the assembly on the inner face and including: a flap extending beyond the lower edge a distance greater than a thickness of the lower edge, a left lower overhang extending beyond the left edge and a right lower overhang extending beyond the right edge.

2. The facade element as recited in claim 1 wherein the at least two longitudinal metallic sections comprise an upper metallic section and a lower metallic section, wherein at least a part of the upper waterproofing membrane is pressed against the inner face of the assembly by the upper metallic section, and wherein at least a part of the lower waterproofing membrane is pressed against the inner face of the assembly by the lower metallic section.

3. The facade element as recited in claim 1 further comprising a side waterproofing membrane attached on the inner face of the assembly of sandwich panels, wherein:

the side waterproofing membrane is attached along at least a part of the left edge of the assembly of sandwich panels and extends beyond the left edge, on a left side of the assembly of sandwich panels, or wherein the side waterproofing membrane is attached along at least a part of the right edge of the assembly of sandwich panels and extends beyond the right edge, on a right side of the assembly of sandwich panels.

4. The facade element as recited in claim 1 further comprising a longitudinal, rain protective profiled lid extending longitudinally along at least a part of the lower edge of the assembly of sandwich panels, the lid being fastened to the outer face of the assembly of sandwich panels and extending outwardly and downwardly, beyond the lower edge of the assembly.

5. A building facade comprising a first, a second, a third and a fourth facade element, each as recited in claim 1, wherein the first, second, third and fourth facade elements are fastened to a building structure; the right edge of the first facade element facing the left edge of the second facade element, the right upper overhang of the first facade element and the left upper overhang of the second facade element overlapping at least partially each other while maintaining a gap between the first and second facade elements;

the lower edge of the third facade element facing the upper edge of the first facade element, the flap of the third facade element extending from the inner face of the third facade element to the outer face of the first facade element;

the right edge of the third facade element facing the left edge of the fourth facade element, the right lower overhang of the third facade element and the left lower overhang of the fourth facade element overlapping at least partially each other while maintaining a gap between the third and fourth facade elements;

the lower edge of the fourth facade element facing the upper edge of the second facade element, the flap of the fourth facade element extending from the inner face of the fourth facade element to the outer face of the second facade element;

the gap between the first and second facade elements being closed with a first side waterproofing membrane attached on the inner faces of both the first and second facade elements;

the gap between the third and fourth facade elements being closed with a second side waterproofing membrane attached on the inner faces of both the third and fourth facade elements.

6. The building facade as recited in claim 5 wherein:

the left lower overhang of the fourth facade element covers up at least partially the right lower overhang of the third facade element, the right lower overhang of the third facade element covers up at least partially the right upper overhang of the first facade element, and the right upper overhang of the first facade element covers up at least partially the left upper overhang of the second facade element, or wherein the right lower overhang of the third facade element covers up at least partially the left lower overhang of the fourth facade element, the left lower overhang of the fourth facade element covers up at least partially the left upper overhang of the second facade element, and the left upper overhang of the second facade element covers up at least partially the right upper overhang of the first facade element.

7. The building facade as recited in claim 5 wherein:

the left lower overhang of the fourth facade element covers up at least partially the right lower overhang of the third facade element, the right lower overhang of the third facade element covers up at least partially the left upper overhang of the second facade element, and the left upper overhang of the second facade element covers up at least partially the right upper overhang of the first facade element, or wherein the right lower overhang of the third facade element covers up at least partially the left lower overhang of the fourth facade element, the left lower overhang of the fourth facade element covers up at least partially the right upper overhang of the first facade element, and the right upper overhang of the first facade element covers up at least partially the left upper overhang of the second facade element.

8. The building facade as recited in claim 5 wherein the gap between the first and second facade elements, and the gap between the third and fourth facade elements each have a width of at least 4 centimeters and are each filled with an insulating material.

9. The building facade as recited in claim 5 wherein a vertical gap is maintained between the first and third facade elements, and between the second and fourth facade elements, the facade further comprising:

one or more fire deflectors fastened to a lower part of the inner face of the third facade element, each fire deflector extending transversally across the vertical gap, up to an outside of the assembly of sandwich panels of the third facade element, to isolate the third facade element from the first facade element, and one or more further fire deflectors fastened to a lower part of the inner face of the fourth facade element, each further fire deflector extending transversally across the vertical gap, up to the outside of the assembly of sandwich panels of the fourth facade element, to isolate the fourth facade element from the second facade element.

10. A method for assembling a building facade, the method comprising:

(i) providing at least a first, a second, a third and a fourth facade element each as recited in claim 1, (ii) positioning and fastening the first facade element on a building structure;

(iii) positioning the left edge, or the right edge, of the second facade element along the right edge, or respectively the left edge, of the first facade element so that the right upper overhang, respectively the left upper overhang, of the first facade element and the left upper overhang, respectively the right upper overhang, of the second facade element overlap at least partially each other while maintaining a gap between the first and second facade elements;

(iv) closing the gap between the first and second facade elements with a first side waterproofing membrane attached on the inner faces of both the first and second facade elements;

(v) positioning the lower edge of the third facade element along the upper edge of the first, respectively second, facade element so that the flap of the third facade element extends on the outer face of the first, respectively second, facade element;

(vi) positioning simultaneously or in any order:

the lower edge of the fourth facade element along the upper edge of the second, respectively first, facade element so that the flap of the fourth facade element extends on the outer face of the second, respectively first, facade element, the left edge, respectively the right edge, of the fourth facade element along the right edge, respectively the left edge, of the third facade element so that the right lower overhang, respectively the left lower overhang, of the third facade element and the left lower overhang, respectively the right lower overhang, of the fourth facade element overlap at least partially each other while maintaining a gap between the third and fourth facade elements;

(vii) closing the gap between the third and fourth facade elements with a second side waterproofing membrane attached on the inner faces of both the third and fourth facade elements.

11. The method as recited in claim 10 further comprising:

gluing the right upper overhang of the first facade element over the left upper overhang of the second facade element, in step (iii); then gluing the right lower overhang of the third facade element over the right upper overhang of the first facade element, in step (v); and then gluing the left lower overhang of the fourth facade element over the right lower overhang of the third facade element, in step (vi).

12. The method as recited in claim 10 further comprising:

gluing the left upper overhang of the second facade element (1B) over the right upper overhang of the first facade element, in step (iii); then gluing the right lower overhang of the third facade element over the left upper overhang of the second facade element, in step (v); and then gluing the left lower overhang of the fourth facade element over the right lower overhang of the third facade element, in step (vi).

13. The method as recited in claim 10 further comprising:

gluing the flap of the lower waterproofing membrane of the third facade element along the upper waterproofing membrane of the first facade element, in step (v); and gluing the flap of the lower waterproofing membrane of the fourth facade element along the upper waterproofing membrane of the second facade element, in step (vi).

14. The method as recited in claim 10 further comprising:

(iv') filling the gap between the first and second facade elements with an insulating material; and (vii') filling the gap between the third and fourth facade elements with an insulating material.

* * * * *